US009585536B2

(12) United States Patent
Pi et al.

(10) Patent No.: US 9,585,536 B2
(45) Date of Patent: Mar. 7, 2017

(54) SURFACE CLEANING APPARATUS

(71) Applicant: BISSELL Homecare, Inc., Grand Rapids, MI (US)

(72) Inventors: Jian Yun Pi, Jiangxi Province (CN); Gang Huang, Dong Guan (CN)

(73) Assignee: BISSELL Homecare, Inc., Grand Rapids, MI (US)

( * ) Notice: Subject to any disclaimer, the term of this patent is extended or adjusted under 35 U.S.C. 154(b) by 342 days.

(21) Appl. No.: 14/192,965

(22) Filed: Feb. 28, 2014

(65) Prior Publication Data

US 2014/0245561 A1 Sep. 4, 2014

Related U.S. Application Data

(60) Provisional application No. 61/771,338, filed on Mar. 1, 2013.

(51) Int. Cl.

| | |
|---|---|
| ***A47L 11/40*** | (2006.01) |
| ***A47L 9/16*** | (2006.01) |
| ***A47L 9/12*** | (2006.01) |
| ***A47L 9/32*** | (2006.01) |
| *B67C 11/00* | (2006.01) |

(52) U.S. Cl.

CPC ..... *A47L 11/4083* (2013.01); *A47L 9/122* (2013.01); *A47L 9/16* (2013.01); *A47L 9/1666* (2013.01); *A47L 9/325* (2013.01); *A47L 11/4027* (2013.01); *A47L 11/4044* (2013.01); *A47L 11/4086* (2013.01); *B67C 2011/20* (2013.01)

(58) Field of Classification Search

CPC ..... A47L 11/4027; A47L 11/4044; A47L 11/4083; A47L 11/4086; A47L 9/122; A47L 9/16; A47L 9/1666; A47L 9/325

USPC ..... 15/339, 319, 320, 321, 322

See application file for complete search history.

(56) References Cited

U.S. PATENT DOCUMENTS

| | | | | |
|---|---|---|---|---|
| 5,341,541 | A | 8/1994 | Sham | |
| 6,571,421 | B1 | 6/2003 | Sham et al. | |
| 8,528,161 | B2 * | 9/2013 | Vrdoljak | A47L 9/02 15/319 |
| 2003/0106180 | A1 * | 6/2003 | Tsen | A47L 5/24 15/321 |
| 2010/0199455 | A1 | 8/2010 | Vrdoljak | |

(Continued)

FOREIGN PATENT DOCUMENTS

| | | |
|---|---|---|
| FR | 2759613 A1 | 8/1998 |
| GB | 2423240 A | 8/2006 |

OTHER PUBLICATIONS

Search Report Under Section 17(5), 3 pages, Intellectual Property Office, Aug. 21, 2014, South Wales.

*Primary Examiner* — Joseph J Hail
*Assistant Examiner* — Marc Carlson
(74) *Attorney, Agent, or Firm* — McGarry Bair PC

(57) ABSTRACT

A surface cleaning apparatus comprises a steam generation system for producing steam from liquid, a liquid distribution system for storing liquid and delivering the liquid to the steam generation system, a steam delivery system for delivering steam to a surface to be cleaned, and a vacuum collection system which can be operated concurrently with the other systems. The surface cleaning apparatus can comprise an upper housing mounted to a lower cleaning foot which is adapted to be moved across a surface to be cleaned.

15 Claims, 14 Drawing Sheets

(56) References Cited

U.S. PATENT DOCUMENTS

2010/0251505 A1* 10/2010 Vrdoljak ..... A47L 9/0686
15/320

* cited by examiner

SURFACE CLEANING APPARATUS

CROSS-REFERENCE TO RELATED APPLICATION

This application claims the benefit of U.S. Provisional Application No. 61/771,338, filed Mar. 1, 2013, which is incorporated herein by reference in its entirety.

BACKGROUND OF THE INVENTION

Surface cleaning apparatuses, such as vacuum cleaners and steam cleaners are configured for cleaning a wide variety of common household surfaces such as bare flooring, including tile, hardwood, laminate, vinyl, and linoleum, as well as carpets, rugs, countertops, stove tops and the like. Vacuum cleaners have a suction source for generating a suction force at a nozzle in contact with the surface to be cleaned and a collection system collects debris from a working airstream for later disposal. Typically, steam cleaners have at least one liquid tank or reservoir for storing a liquid, generally water, which is fluidly connected to a steam generator via a flow control mechanism, such as a pump or valve. The steam generator includes a heater for heating the liquid to produce steam, which can be directed towards the surface to be cleaned through a steam outlet, typically located in a foot or cleaning head that engages the surface to be cleaned during use. The steam is typically applied to the backside of a cleaning pad that is attached to the cleaning head. The steam saturates the cleaning pad, and the damp cleaning pad is wiped across the surface to be cleaned to remove dirt, debris, and other soils present on the surface. Some surface cleaning apparatus combine multiple types of cleaning actions, such as vacuum cleaning with steam cleaning. In this case, both liquid and debris can be collected from a surface to be cleaned, but many combination apparatuses operate the vacuum and steam cleaning functions separately in order to avoid collecting liquid at the same time as dry debris.

BRIEF DESCRIPTION OF THE INVENTION

According to one aspect of the invention, a combination steam and vacuum surface cleaning apparatus includes a vacuum collection system having a suction nozzle, a separating and collection assembly in fluid communication with the suction nozzle and having a collection chamber which receives debris, and a suction source fluidly connected to the suction nozzle and the separating and collection assembly, a liquid distribution system including a liquid supply tank, a steam generation system including a steam generator in fluid communication with the liquid supply tank and having a liquid inlet receiving liquid from the supply tank, and a steam delivery system including a steam outlet in fluid communication with the steam generator and delivering steam to a surface to be cleaned and a deflector directing steam away from the suction nozzle. The steam generator and suction source can be energized concurrently to deliver steam to the surface to be cleaned and simultaneously remove and collect debris and liquid from the surface to be cleaned, and wherein the collection chamber remains perceptibly dry during and after concurrent operation of the steam generator and suction source.

According to another aspect of the invention, a combination steam and vacuum surface cleaning apparatus includes a vacuum collection system having a suction nozzle, a cyclonic separating and collection assembly in fluid communication with the suction nozzle and having a cyclone chamber for separating debris from a working airstream and a collection chamber which receives debris separated by the cyclone chamber, and a suction source fluidly connected to the suction nozzle and the separating and collection assembly, a liquid distribution system including a liquid supply tank, a steam generation system including a steam generator in fluid communication with the liquid supply tank and having a liquid inlet receiving liquid from the supply tank, and a steam delivery system including a steam outlet in fluid communication with the steam generator and delivering steam to a surface to be cleaned. The steam generator and suction source can be energized concurrently to deliver steam to the surface to be cleaned and simultaneously remove and collect debris and liquid from the surface to be cleaned, and wherein the collection chamber remains perceptibly dry during and after concurrent operation of the steam generator and suction source.

BRIEF DESCRIPTION OF THE DRAWING(S)

DETAILED DESCRIPTION OF THE INVENTION

Figure 1:
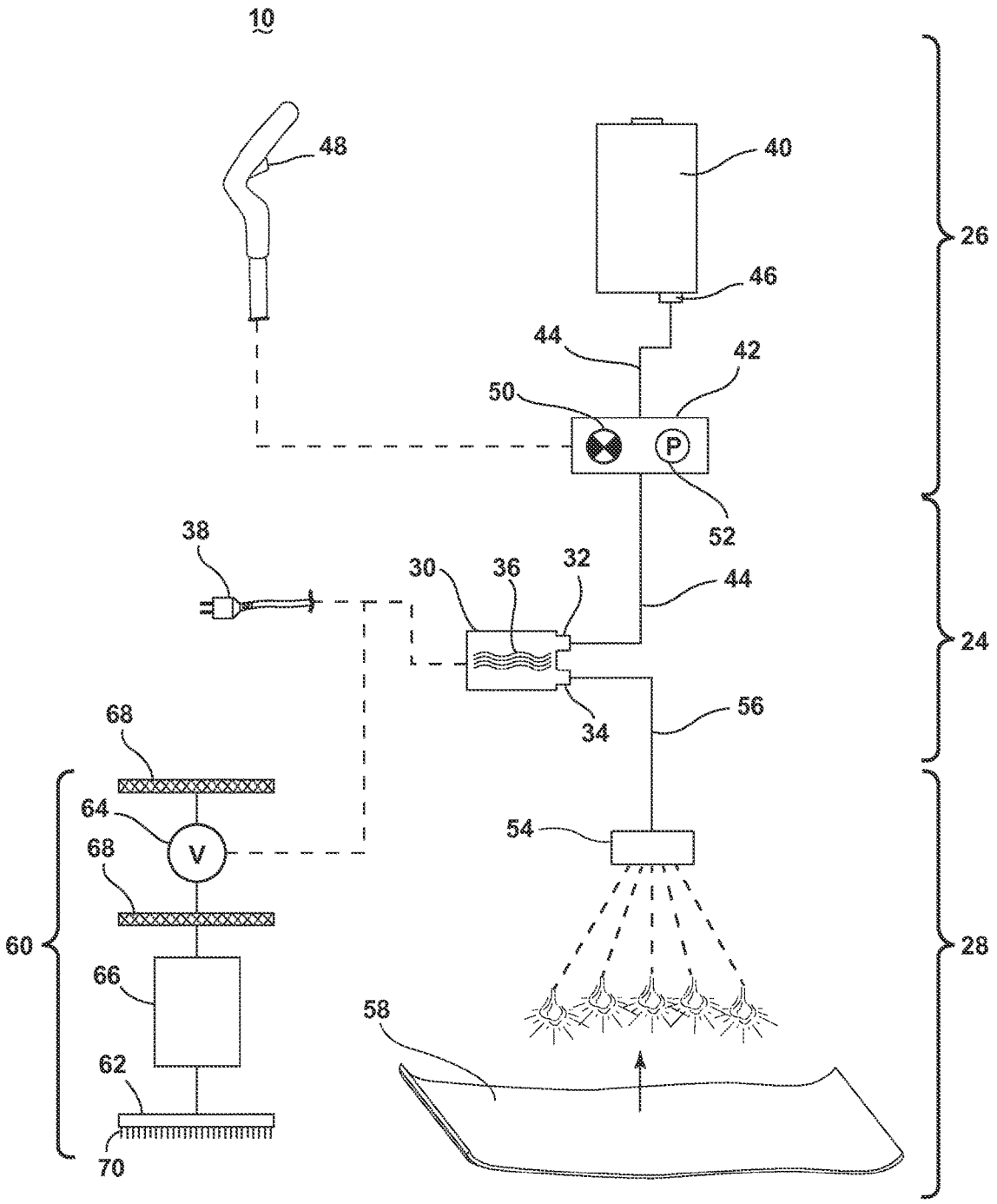
FIG. 1 is a schematic view of a surface cleaning apparatus.

FIG. 1 is a schematic view of various functional systems of a surface cleaning apparatus in the form of a steam/vacuum cleaner 10. While referred to herein as a steam/vacuum cleaner 10, some aspects of the apparatus can alternatively be configured as steam cleaner without vacuum capability, a vacuum cleaner without steam capability, a hand-held device, or as an apparatus having a hand-held accessory tool connected to a canister or other portable device by a hose. Additionally, the surface cleaning apparatus can be configured to have additional capability, including scrubbing, sweeping, and/or extraction capability.

As used herein, the term "steam" includes a liquid, such as but not limited to water or solutions containing water (like water mixed with a cleaning chemistry, fragrance, etc.), converted to a gas or vapor phase. The liquid can be boiled or otherwise converted to the gas or vapor phase by heating or mechanical action like nebulizing. The steam can be invisible to the naked eye, in the form of a visible mist formed when the gas or vapor condenses in air, or combinations thereof.

The steam/vacuum cleaner 10 includes a steam generation system 24 for producing steam from liquid, a liquid distribution system 26 for storing liquid and delivering the liquid to the steam generation system 24, a steam delivery system 28 for delivering steam to a surface to be cleaned, and a vacuum collection system 60 for creating a partial vacuum to suck up liquid and debris from a surface to be cleaned and collecting the debris from a working airstream for later disposal.

The steam generation system 24 can include a steam generator 30 for producing steam from liquid. The steam generator 30 can include an inlet 32 and an outlet 34, and a heater 36 between the inlet 32 and outlet 34 for boiling the liquid. Some non-limiting examples of steam generators 30 include, but are not limited to, a flash heater, a boiler, an immersion heater, and a flow-through steam generator. The steam generator 30 can be electrically coupled to a power source 38, such as a battery or by a power cord plugged into a household electrical outlet.

The liquid distribution system 26 can include at least one supply tank 40 for storing a supply of liquid. The liquid can comprise one or more of any suitable cleaning liquids, including, but not limited to, water, compositions, concentrated detergent, diluted detergent, etc., and mixtures thereof. For example, the liquid can comprise a mixture of water and concentrated detergent. The liquid distribution system 26 can further include multiple supply tanks, such as one tank containing water and another tank containing a cleaning agent.

The liquid distribution system 26 can comprise a flow controller 42 for controlling the flow of liquid through a fluid conduit 44 coupled between an outlet port 46 of the supply tank 40 and the inlet 32 of the steam generator 30. An actuator 48 can be provided to actuate the flow controller 42 and dispense liquid to the steam generator 30.

In one configuration, the liquid distribution system 26 can comprise a gravity-feed system and the flow controller 42 can comprise a valve 50, whereby when valve 50 is open, liquid will flow under the force of gravity, through the fluid conduit 44, to the steam generator 30. The actuator 48 can be operably coupled to the valve 50 such that pressing the actuator 48 will open the valve 50. The valve 50 can be mechanically actuated, such as by providing a push rod with one end coupled to the actuator 48 and another end in register with the valve 50, such that pressing the actuator 48 forces the push rod to open the valve 50. Alternatively, the valve 50 can be electrically actuated, such as by providing an electrical switch between the valve 50 and the power source 38 that is selectively closed when the actuator 48 is actuated, thereby powering the valve 50 to move to an open position.

In another configuration, the flow controller 42 can comprise a pump 52 that distributes liquid from the supply tank 40 to the steam generator 30. The actuator 48 can be operably coupled to the pump 52 such that pressing the actuator 48 will activate the pump 52. The pump 52 can be electrically actuated, such as by providing electrical switch between the pump 52 and the power source 38 that is selectively closed when the actuator 48 is actuated, thereby activating the pump 52.

The steam delivery system 28 can include at least one steam outlet 54 for delivering steam to the surface to be cleaned, and a fluid conduit 56 coupled between an outlet 34 of the steam generator 30 and the at least one steam outlet 54. The at least one steam outlet 54 can comprise any structure, such as a perforated manifold or at least one nozzle; multiple steam outlets can also be provided. In use, the generated steam exits the outlet 34 of the steam generator 30 by pressure generated within the steam generator 30 and, optionally, by pressure generated by the pump 52. The steam flows through the fluid conduit 56, and out of the at least one steam outlet 54.

A cleaning pad 58 can be removably attached over the steam outlet 54 to the steam/vacuum cleaner 10. In use, the cleaning pad 58 is saturated by the steam from the steam outlet 54, and the damp cleaning pad 58 is wiped across the surface to be cleaned to remove dirt present on the surface. The cleaning pad 58 can be provided with features that enhance the scrubbing action on the surface to be cleaned to help loosen dirt on the surface. The cleaning pad 58 can be disposable or reusable, and can further be provided with a cleaning agent or composition that is delivered to the surface to be cleaned along with the steam. For example, the cleaning pad 58 can comprise disposable sheets that are pre-moistened with a cleaning agent. The cleaning agent can be configured to interact with the steam, such as having at least one component that is activated or deactivated by the temperature and/or moisture of the steam. In one example, the temperature and/or moisture of the steam can act to release the cleaning agent from the cleaning pad 58.

The vacuum collection system 60 can include a suction nozzle 62, a suction source 64 in fluid communication with the suction nozzle 62 for generating a working air stream, and a separating and collection assembly 66 for separating and collecting debris from the working airstream for later disposal. Some examples of separating and collection assemblies 66 include, but are not limited to, a cyclone separator, a centrifugal separator, a bulk separator, a filter bag, or a water-bath separator. The collection assembly 66 can further be configured to separate liquid from the working air; however, as described below most or all of the liquid is separated from the working airstream prior to entering the collection assembly 66, and so any remaining liquid would be imperceptible and would not require any special features directed to separating and collecting liquid. As perceived by a user of the steam/vacuum cleaner 10, the separating and collection assembly 66 separates and collects only dry debris.

The suction source 64, such as a motor/fan assembly, is provided in fluid communication with the separating and collection assembly 66, and can be positioned downstream or upstream of the separating and collection assembly. The suction source 64 can be electrically coupled to the power source 38. An electrical switch between the suction source 64 and the power source 38 can be selectively closed by the user upon pressing a power button (not shown), thereby activating the suction source 64.

The vacuum collection system 60 can also be provided with one or more additional filters 68 upstream or downstream of the separating and collection assembly 66 or the suction source 64. Optionally, an agitator 70 can be provided adjacent to the suction nozzle 62 for agitating debris on the surface to be cleaned so that the debris is more easily ingested into the suction nozzle 62. Some examples of agitators 70 include, but are not limited to, a rotatable brushroll, dual rotating brushrolls, or a stationary brush.

The steam/vacuum cleaner 10 shown in FIG. 1 can be used to effectively remove debris (which may include dirt, dust, stains, and other debris) from the surface to be cleaned in accordance with the following method. The sequence of steps discussed is for illustrative purposes only and is not meant to limit the method in any way as it is understood that the steps may proceed in a different logical order, additional or intervening steps may be included, or described steps may be divided into multiple steps, without detracting from the invention.

To perform steam cleaning, the cleaning pad 58 is attached to the steam/vacuum cleaner 10, over the steam outlet 54, the supply tank 40 is filled with liquid, and the steam generator 30 is coupled to the power source 38. Upon actuation of the actuator 48, liquid flows to the steam generator 30 and is heated to its boiling point to produce steam. The steam exits the steam outlet 54 and passes through the cleaning pad 58. As steam passes through the cleaning pad 58, a portion of the steam may return to liquid form before reaching the floor surface. The steam delivered to the floor surface can sanitize the surface when exposed for a predetermined amount of time before returning to liquid form. As the damp cleaning pad 58 is wiped over the surface to be cleaned, debris is loosened or solubilized, and excess liquid, dirt and debris on the surface are absorbed by the cleaning pad 58.

To perform vacuum cleaning, the suction source 64 is coupled to the power source 38. The suction source 64 draws in dirt-laden air through the suction nozzle 62 and into the separating and collection assembly 66 where the debris is substantially separated from the working air. The air flow then passes past the suction source 64, and through any optional filters 68, prior to being exhausted from the vacuum cleaner 10. The separating and collection assembly 66 can be periodically emptied of debris. Likewise, the optional filters 68 can periodically be cleaned or replaced. The suction source 64 may also draw in liquid through the suction nozzle 62 and most or all of the liquid is separated from the working airstream prior to entering the collection assembly 66.

Figure 2:
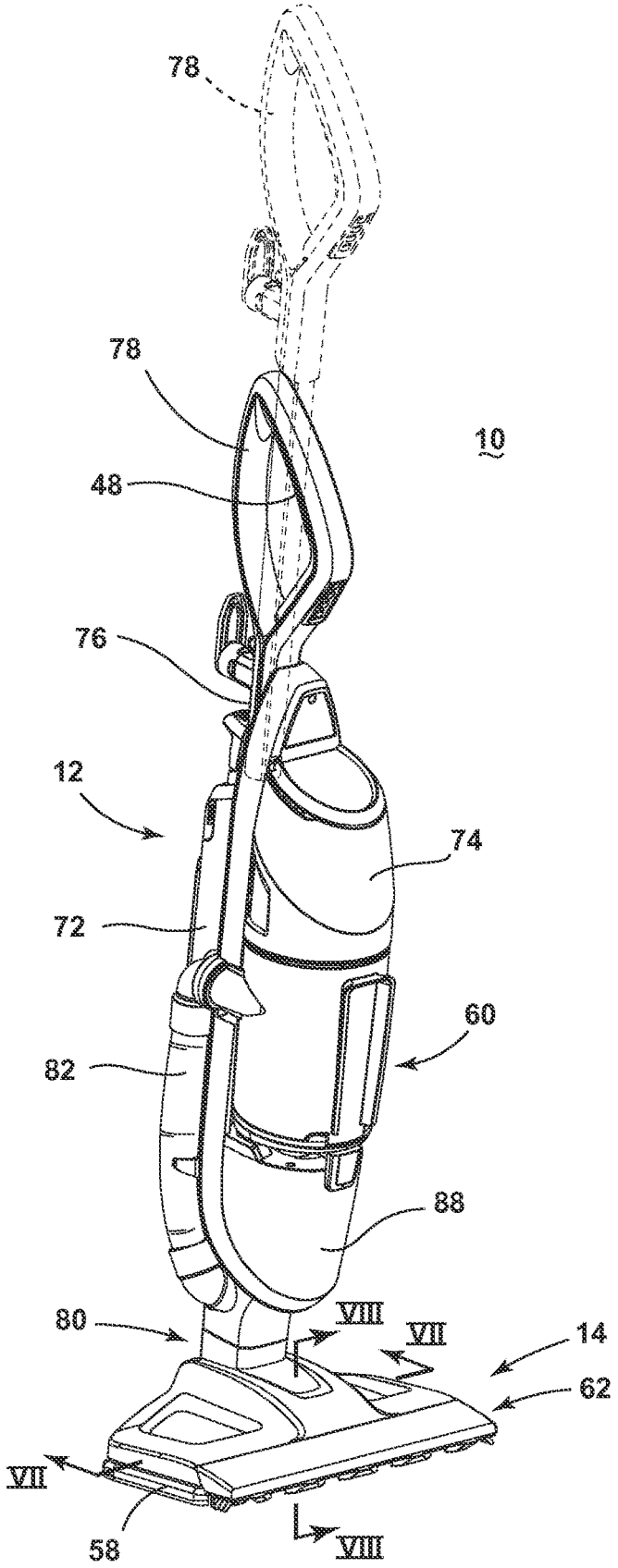
FIG. 2 is a front perspective view of a surface cleaning apparatus in the form of a steam/vacuum cleaner according to a first embodiment of the invention.

FIG. 2 is a front perspective view of a steam cleaning apparatus in the form of a steam/vacuum cleaner 10 according to a first embodiment of the invention. For purposes of description related to the figures, the terms "upper," "lower," "right," "left," "rear," "front," "vertical," "horizontal," "inner," "outer," and derivatives thereof shall relate to the invention as oriented in FIG. 1 from the perspective of a user behind the steam/vacuum cleaner 10, which defines the rear of the steam/vacuum cleaner 10. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The steam/vacuum cleaner 10 comprises an upper housing 12 mounted to a lower cleaning foot 14 which is adapted to be moved across a surface to be cleaned. The housing 12 and the foot 14 may each support one or more components of the various functional systems discussed with respect to FIG. 1. The upper housing 12 generally comprises a main support section 72 with a separating and collection assembly 66 on a front portion thereof for separating and collecting debris, and optionally some amount of liquid, from a working airstream for later disposal. A motor cavity 74 is formed at an upper end of the support section 72, above the collection assembly 66, and contains a conventional suction source such as a motor/fan assembly 64 (FIGS. 1 and 9) positioned therein in fluid communication with the collection assembly 66. The foot 14 includes a suction nozzle 64 that is in fluid communication with the suction source in the motor cavity 74, through the collection assembly 66.

An elongated handle 76 can project from the main support section 72, with a handle grip 78 provided on the end of the handle 76 to facilitate movement of the steam/vacuum cleaner 10 by a user. The actuator 48 can be provided on the handle grip 78. A coupling joint 80 is formed at an opposite end of the housing 12 and moveably mounts the foot 14 to the housing 12. In the embodiment shown herein, the foot 14 can pivot up and down about one axis relative to the housing 12. The coupling joint 80 can alternatively comprise a universal joint, such that the foot 14 can pivot about at least two axes relative to the housing 12. The working air conduit between the suction nozzle 64 and the collection assembly 66 can extend though the coupling joint 80 and an external conduit 82 connected between the coupling joint 80 and the collection assembly 66. The external conduit 82 can be a flexible hose or a rigid conduit.

Figure 3:
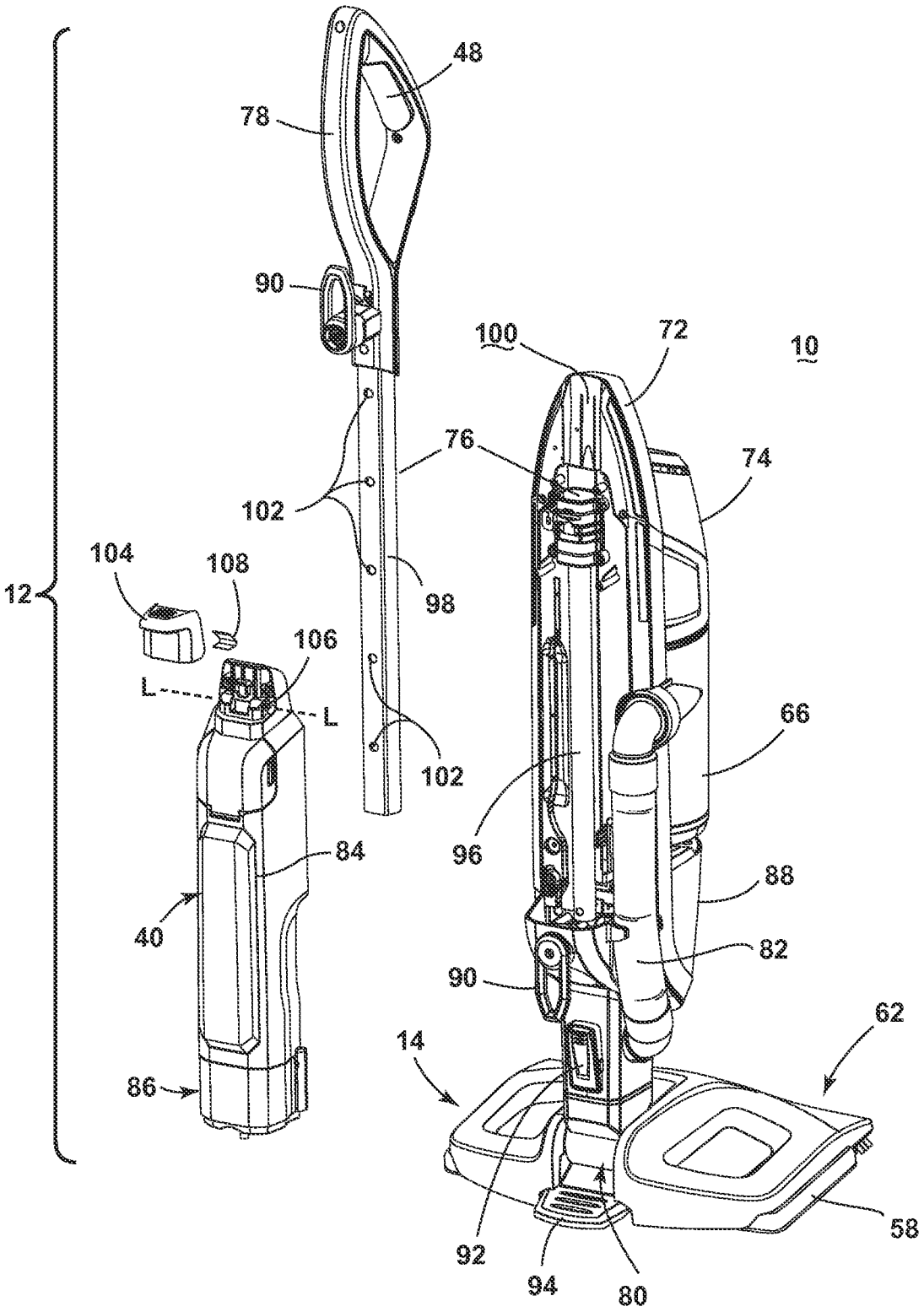
FIG. 3 is a partially exploded rear perspective view of the steam/vacuum cleaner from FIG. 2.

FIG. 3 is a rear perspective, partially exploded view of the steam/vacuum cleaner 10. The upper housing 12 further comprises a supply tank 40 supported on a rear portion of the main support section 72 for storing a supply of liquid. The housing 12 has a window 84 which allows the user to view the supply tank 40 and ascertain the level of liquid within the supply tank 40. A filter assembly 86 is supported on a rear portion of the main support section 76, below the supply tank 40, for filtering the liquid passing out of the supply tank 40. A heater cavity 88 is formed at a front, lower end of the support section, below the collection system, and contains a steam generator 30 (FIGS. 1 and 9) positioned therein in fluid communication with the supply tank 40, through the filter assembly 86. Cord wraps 90 are provided on the rear portion of the upper housing 12, below and above the supply tank 40, and store a power cord (such as power cord 38 shown in FIG. 1) which can plugged into a household electrical outlet to provide power to various components of the steam/vacuum cleaner, such as but not limited to the steam generator 30 and the suction source 64. The foot 14 is detachably mounted to the upright housing 12 by a latch 92 provided on the rear of the coupling joint 80. The foot 14 includes a cleaning pad 58 mounted to a bottom surface of the foot 14 to contact the surface to be cleaned and a removable pad mounting plate 94 provided on the bottom of the foot 14 for mounting the cleaning pad 58 to the foot 14.

The handle 76 of the steam/vacuum cleaner 10 is height-adjustable, and can telescope between a fully retracted position shown in solid line in FIG. 1, which corresponds to the shortest length of the handle 76, and a fully extended position shown in phantom line in FIG. 1, which corresponds to the longest length of the handle 76. The telescoping handle 76 comprises an inner handle tube 96 and an outer handle tube 98 sliding received over the inner handle tube 96. The main support section 72 and the supply tank 40 together define a cavity 100 that is configured to slidably receive the telescoping handle 76 therein, with the inner handle tube 96 fixed in place and the upper handle tube 98 configured to slide upwardly and downwardly relative the stationary inner handle tube 96. The outer handle tube 98 comprises a plurality of detents 102, illustrated as recessed depressions, for adjusting the handle 76 between the fully extended and retracted positions shown in FIG. 1, or various intermediate positions therebetween (not shown). The hand grip 78 is provided on the top of the outer handle tube 98. The upper cord wrap 90 can also be carried by the outer handle tube 98.

A handle locking mechanism is provided on the rear side of the main support section 72 and comprises a spring loaded button 104 pivotally mounted on the main support section 72 about an axis L that is defined by a button bearing 106 on the main support section 72, above the supply tank 40. A spring 108 biases the button 104 toward the outer handle tube 98.

Figure 5:
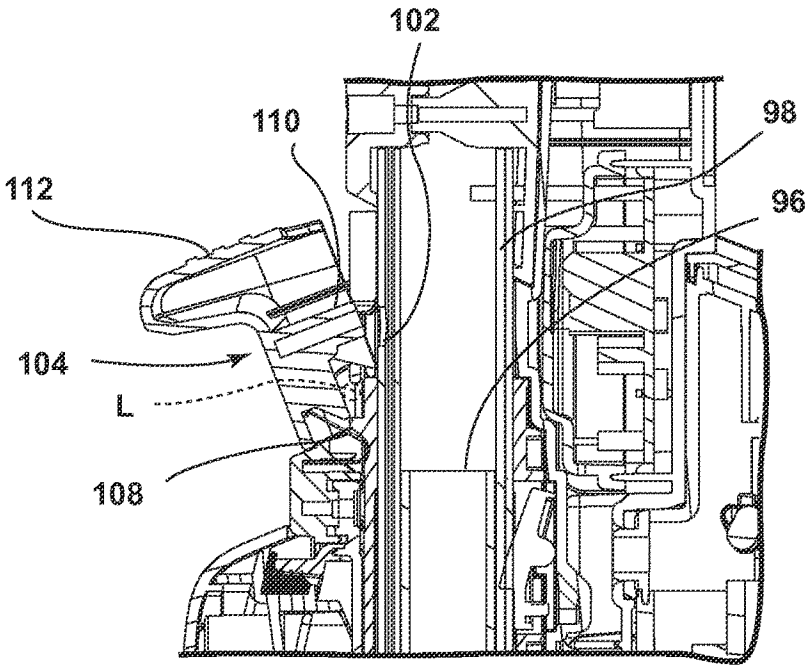
FIG. 4-5 are sectional views through a handle locking mechanism of the steam/vacuum cleaner from FIG. 2.
Figure 4:
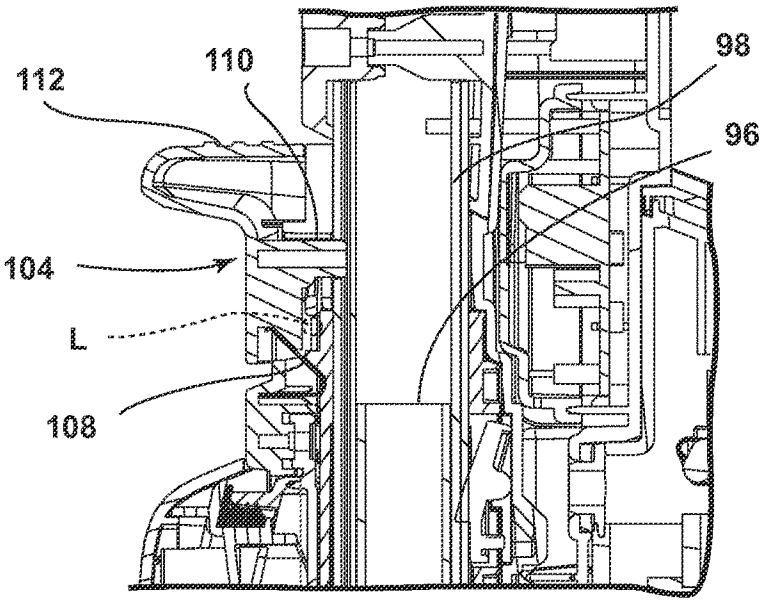

FIGS. 4-5 are sectional views through the assembled handle locking mechanism. The button 104 is coupled with a latch 110 configured to engage one of the detents 102 in the outer handle tube 98, as shown in FIG. 4. The spring 108 biases the latch 110 toward the detent 102. To adjust the height or length of the handle 76, a user can depress an upper portion 112 of the button 104, causing the button 104 to pivot about the axis L and move the latch 110 out of engagement with the detent 102, as shown in FIG. 5. The user then slides the outer handle tube 98 over the inner handle tube 96 to a desired length, and releases the button 104 to allow the latch 110 to engage the detent 102 associated with the desired length.

Figure 6:
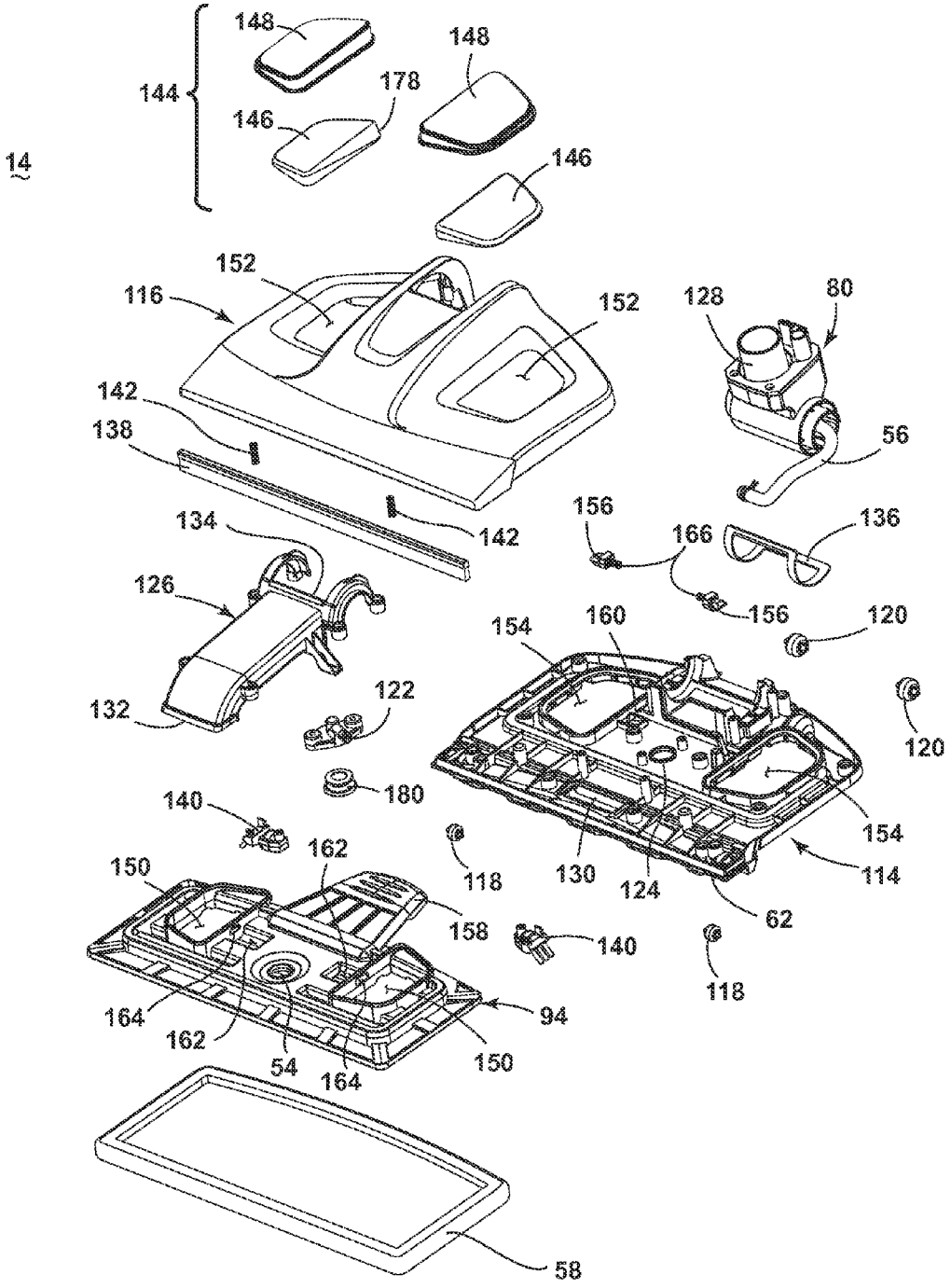
FIG. 6 is an exploded view of a foot of the steam/vacuum cleaner from FIG. 2.

FIG. 6 is an exploded view of the foot 14 of the steam/vacuum cleaner 10 shown in FIG. 2. The foot 14 can comprise a housing adapted to be moved over the surface to be cleaned and which can mount the cleaning pad 58, generally described with respect to FIG. 1. The housing includes a base frame 114 and an upper cover 116 mounted to the top of the base frame 114. The removable pad mounting plate 94 is provided on the bottom of the base frame 114 for mounting the cleaning pad 58 in register with the foot 14. A set of front wheels 118 and a set of rear wheels 120 are provided on the base frame 114 for maneuvering the foot 14 over a surface to be cleaned.

The foot 14 includes a steam nozzle 122 and at least one steam outlet 54 in fluid communication with the steam nozzle 122. In the illustrated embodiment, the at least one steam outlet includes a steam orifice 54 formed in the pad mounting plate 94. A steam port 124 is formed in the base frame 114 and aligned with the steam orifice 54 to provide a passage for steam from the steam nozzle 122 through the base frame 114. A fluid conduit 56 is coupled between the steam generator 30 (FIGS. 1 and 9) and the steam nozzle 122, and can extend at least partially through the coupling joint 80. At least a portion of the conduit 56 can be flexible to accommodate for the movement of the coupling joint 80.

Figure 6A:
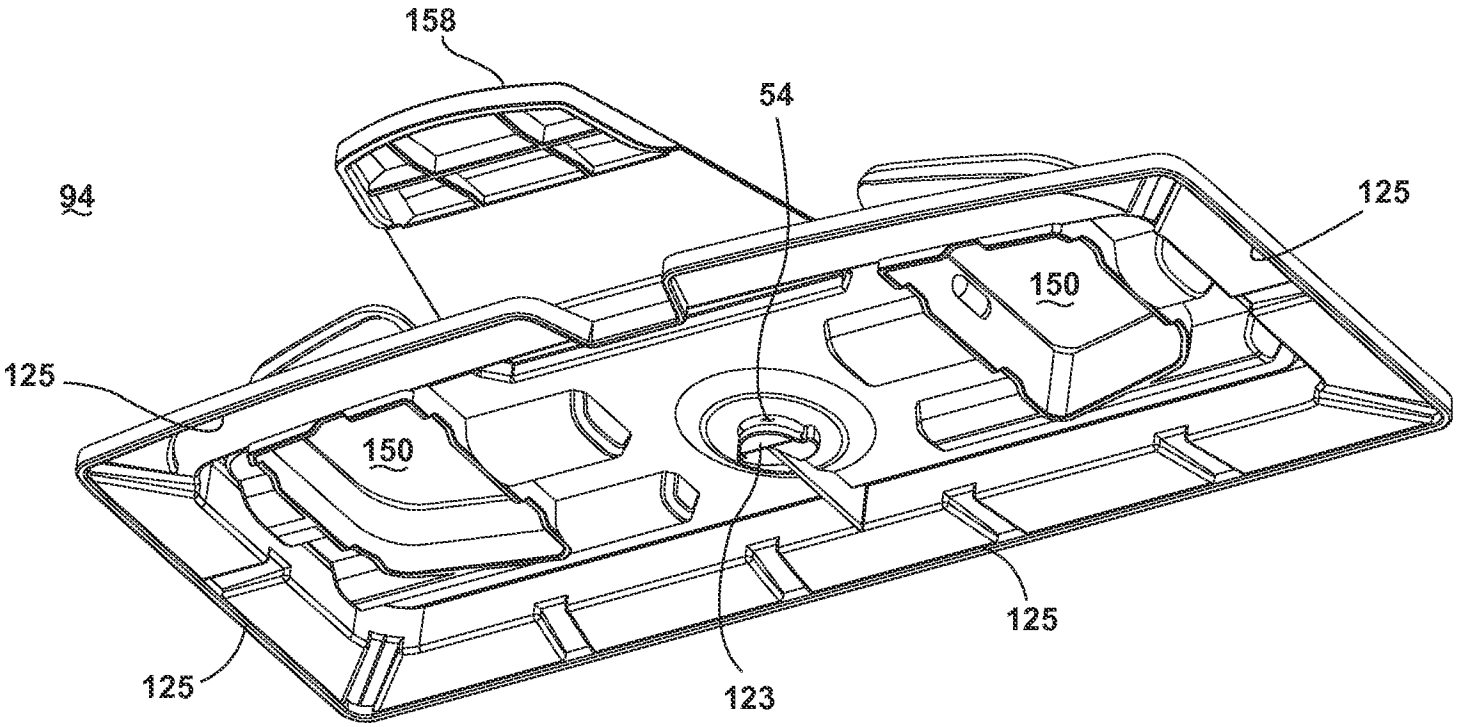
FIG. 6A is a bottom view of a pad mounting plate of the foot from FIG. 6.
Figure 8:
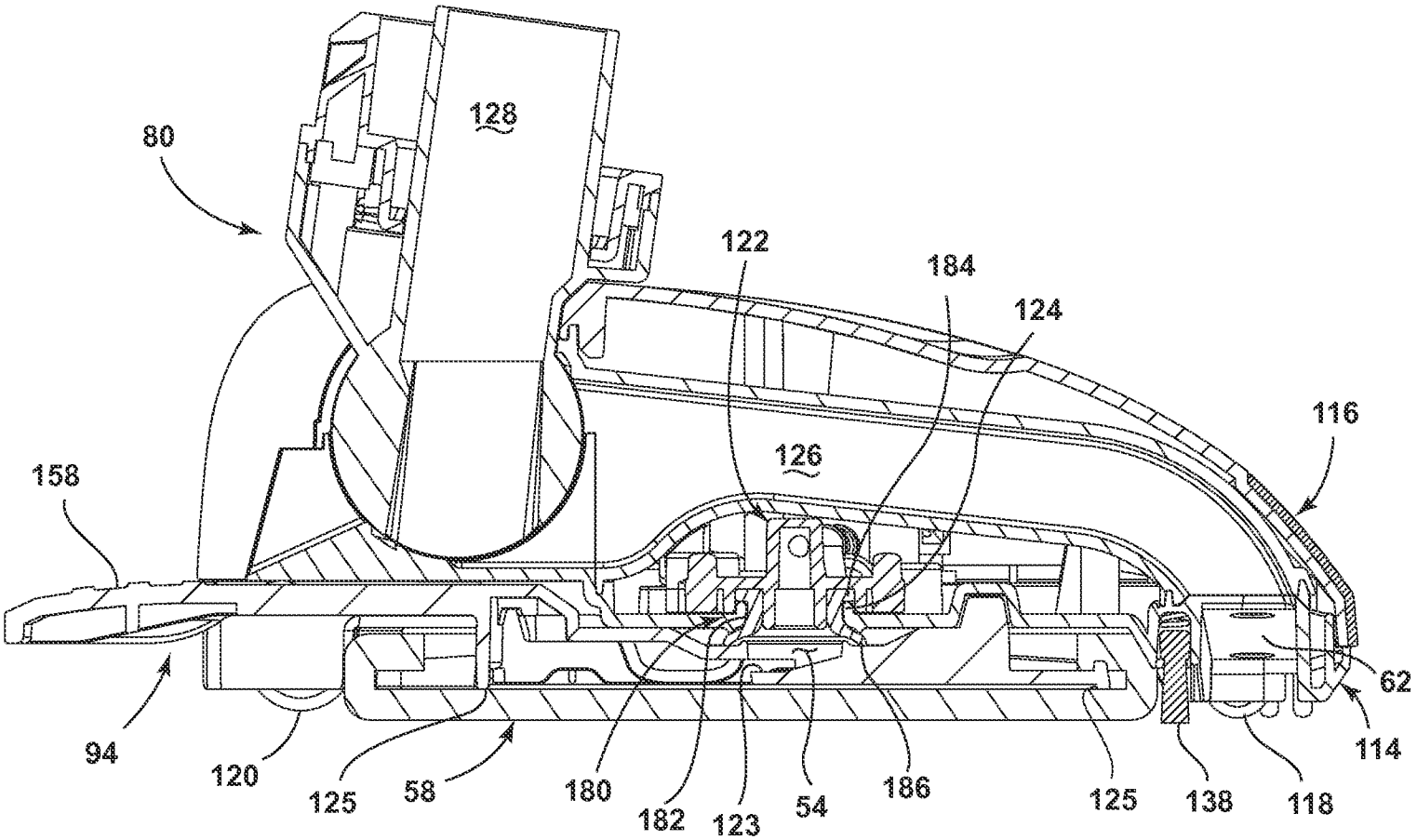
FIG. 8 is a cross-sectional view through a foot of the steam/vacuum cleaner from FIG. 2, taken through line VIII-VIII of FIG. 2.

FIG. 6A is a bottom view of the pad mounting plate 94. The pad mounting plate 94 can comprise features that minimize the amount of liquid and steam ingested through the suction nozzle 62, which can help prevent a perceptible amount of liquid from entering downstream collection assembly 66. As used herein, a perceptible amount of liquid refers to an amount of liquid that can be visually observed either within the collection assembly 66 during and after use, or visual signs of moisture on a paper towel after wiping down the inside surface of the collection assembly 66 after use. Examples of features that minimize the amount of liquid and steam ingested comprise the steam orifice 54, which is defined by a deflector 123 formed on a bottom surface of the pad mounting plate 94 that is configured to guide steam downwardly and rearwardly relative to the suction nozzle 62, as best shown in FIG. 8. The deflector 123 is shown as a hood which faces rearwardly such that it is closed to steam toward the front and directly below the steam orifice 54 and open to steam toward the rear of the steam orifice 54. Guiding the steam rearwardly prevents the steam from flowing forwardly and being ingested through the suction nozzle 62 to enter the downstream collection assembly 66. Additionally, the bottom of the pad mounting plate 94 comprises a raised lip 125 extending continuously around the perimeter of the plate 94 and surrounding the steam outlet 54. The lip 125 is configured to press into the top of the cleaning pad 58 when the pad is mounted on the mounting plate 94 and thus forms a steam- and liquid-impermeable barrier that forces steam and/or liquid through the bottom of the mop pad 58 instead of bypassing the pad 58 and potentially flowing around the top of the pad mounting plate 94 and into the suction nozzle 62.

Referring back to FIG. 6, the foot 14 further includes a flue 126 extending from the suction nozzle 62 to a fluid conduit 128 in fluid communication with the collection assembly 66 (FIG. 2). The fluid conduit 128 can pass through the coupling joint 80 and couple with the conduit 82. The suction nozzle 62 is formed with the base frame 114 and comprises a nozzle inlet 130 which mates with an inlet end 132 of the flue 126. An outlet end 134 of the flue 126 mates with the coupling joint 80, which can rotate relative to the outlet end 134. A seal 136 can be positioned between the flue 126 and the coupling joint 80 to maintain a fluid-tight connection throughout the range of movement of the coupling joint 80.

In addition to the cleaning pad 58, the foot 14 can be provided with one or more additional agitators. In the illustrated embodiment, the foot 14 is provided with an elongated, brush 138 positioned behind the suction nozzle 62 and a pair of edge brushes 140 positioned at the ends of the suction nozzle 62 and which protrude outwardly from the base frame 114. The brushes 138, 140 can include a plurality of bristles. The brush 138 can be slidably mounted to the base frame 114 to float over the surface to be cleaned, such that the brush 138 automatically adjusts to different floor surface features, carpet pile heights, bare floor, etc. A spring 142 is positioned between the bottom of the base frame 114 and the top of the brush 138 for biasing the brush downwardly toward the surface to be cleaned, while still permitting the brush 138 to move freely up and down, or float, along the surface to be cleaned during operation, thereby permitting the brush 138 to automatically adjust to the type of surface below the foot 14. Optionally, a squeegee can replace, or be used in conjunction with, the brush 138.

In addition to agitating the surface to be cleaned, the brush 138 can minimize the amount of liquid and steam ingested through the suction nozzle 62, which can prevent a perceptible amount of liquid from entering the downstream collection assembly 66. The brush 138 forms a steam- and liquid-permeable barrier between the steam outlet 54 and suction nozzle 62 that impedes the flow path of liquid and steam located rearwardly of the brush 138 drawn towards the suction nozzle 62 by the working airstream. The optional use of a squeegee to replace, or be used in conjunction with, the brush 138 can also prevent a perceptible amount of liquid from entering the downstream collection assembly 66. The squeegee can form a steam- and liquid-impermeable barrier between the steam outlet 54 and suction nozzle 62.

The foot 14 is provided with one more viewing window(s) 144 to allow the user to view the cleaning pad 58 mounted to the foot 14. The viewing windows 144 also allow for the user to see the condensation of steam on the windows 144, which acts as a visual confirmation that steam is being produced and delivered to the foot 14. In the illustrated embodiment, a viewing window 144 is provided on each side of the coupling joint 80. Each window 144 comprises an inner pane 146 mounted to the pad mounting plate 94 and an outer pane 148 mounted to the base cover 116. The inner panes 146 can seat within the outer panes 148 when the pad mounting plate 94 is coupled with the foot 14. Both panes 146, 148 can be made of a light transmissive material. In other embodiments, only a single pane of light transmissive material may be required.

The pad mounting plate 94 and the base cover 116 can be provided with aligned window cutouts 150, 152, respectively, and the panes 146, 148 are mounted at the cutouts 150, 152. Likewise, the base frame 114 is provided with window cutouts 154 aligned with the other cutouts 150, 152. The outer pane 148 can be sized to receive the inner pane 146, which extends through the window cutouts 154 in the base frame 114 when the pad mounting plate 94 is coupled with the foot 14. Alternatively the panes 146, 148 can be integrally formed with the pad mounting plate 94, base cover 116, or base frame 114.

The foot 14 has a lock mechanism for selectively locking the pad mounting plate 94 to the base frame 114. In the illustrated embodiment, the locking mechanism comprising two opposing spring-biased latches 156 moveably mounted to the base frame 114 and a user engageable latch actuator, illustrated and described as a foot pedal 158, coupled with the pad mounting plate 94. The latches 156 can be slidably mounted in pockets 160 provided on the base frame 114. The pad mounting plate 94 is provided with pocket receivers 162 which accommodate the pockets 160 when the pad mounting plate 94 is coupled with the foot 14. Detents 164 corresponding to the latches 156 are formed in the pocket receivers 162. Biasing elements 166 can be provided within the pockets 160 to bias the latches 156 outwardly toward the corresponding detents 164 formed in the pad mounting plate 94. The biasing elements 166 can comprise springs in the form of coil springs.

Figure 7:
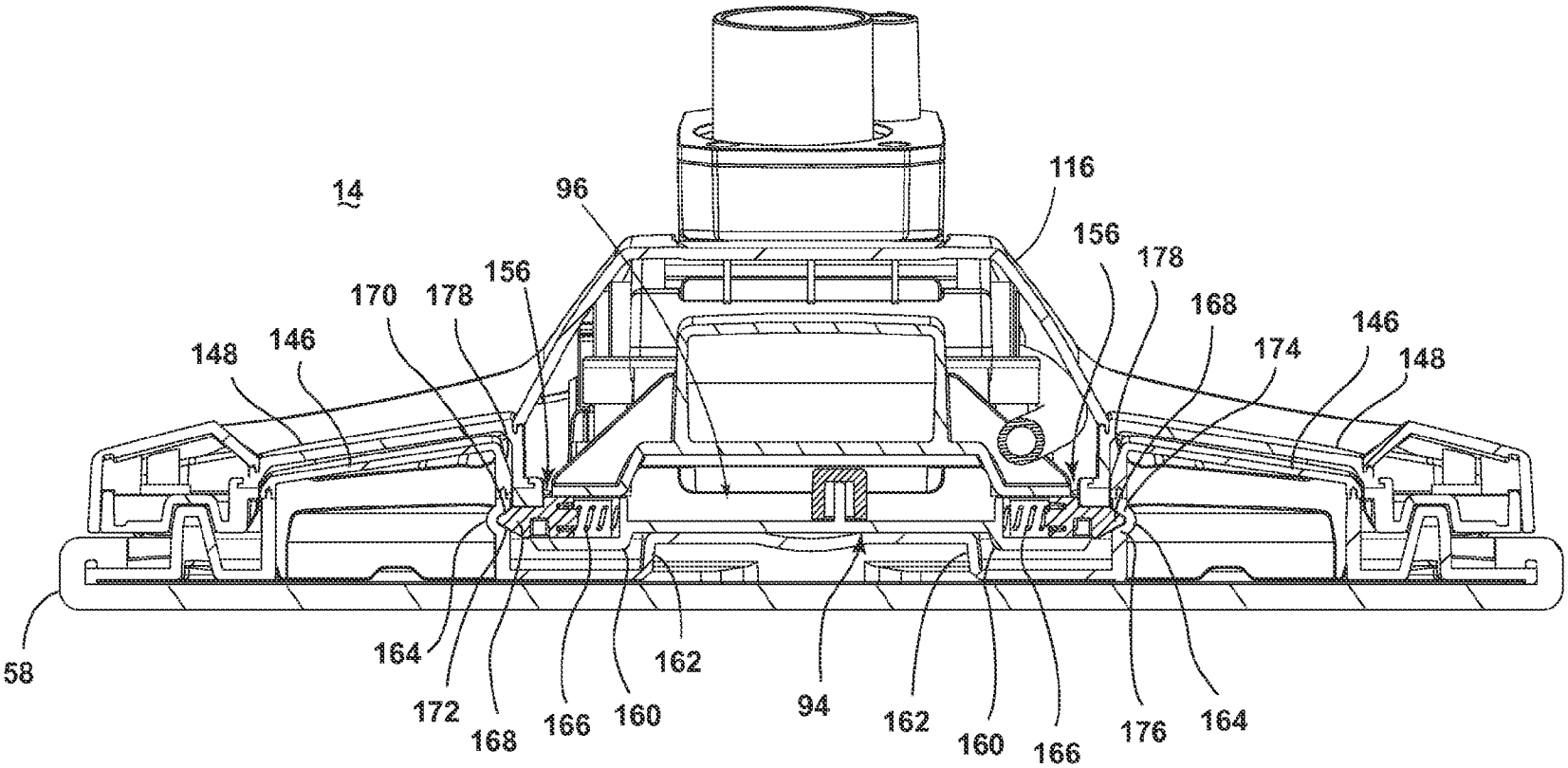
FIG. 7 is a cross-sectional view through a foot of the steam/vacuum cleaner from FIG. 2, taken through line VII-VII of FIG. 2.

FIG. 7 is a cross-sectional view through the lock mechanism for the pad mounting plate 94, taken through line VII-VII of FIG. 2. Each latch 156 has an arrow-shaped catch 168 which move into and out of the pockets 160 to engage or disengage the detents 164. The arrow-shaped catch 168 has upper and lower angled surfaces 170, 172. The detent 164 has a corresponding arrow-shape with upper and lower angled surfaces 174, 176. A guide surface 178 can be provided on the pad mounting plate 94 for guiding the catches 168 toward the detents 164. As shown herein, the guide surfaces 178 can be angled edges of the inner window panes 146.

With reference to FIGS. 6-7, to attach the pad mounting plate 94 to the foot 14, a user can locate the front edge of the pad mounting plate 94 behind the suction nozzle 62 and press the foot 14 toward the pad mounting plate 94. The lower angled surface 172 of the catch 168 contacts the guide surface 178 on the pad mounting plate 94, which forces the latch 156 inwardly and compresses the biasing element 166 within the pocket 160. When the pad mounting plate 94 is fully seated, the biasing element 166 pushes the latch 156 outwardly so that the catch 168 extends into the detent 164 to retain the pad mounting plate 94 to the base frame 114 of the foot 14. To remove the pad mounting plate 94, the user simply steps or pushes down on the foot pedal 158 of the pad mounting plate 94 while lifting upwardly on the foot 14, such as by lifting the steam/vacuum cleaner 10 by the upright housing 12 (FIG. 2). This forces the upper angled surface 172 of the catch 168 against the upper angled surface 174 of the detent 164 and urges the latch 156 inwardly until the catch 168 clears the detent 164 and the steam/vacuum cleaner 10 can be lifted away from the pad mounting plate 94.

The lock mechanism for the pad mounting plate 94 can make it especially convenient for the user to assemble or remove the cleaning pad 58 since a user can pick up the removed pad mounting plate 94 and attach the cleaning pad 58 at their convenience, rather than having to bend over or flip the entire steam/vacuum cleaner 10 over. For example, a user could remove the pad mounting plate 94, pick up the pad mounting plate 94, and place the pad mounting plate 94 on a countertop to remove or mount the cleaning pad 58. To re-install the pad mounting plate 94, the user can set the pad mounting plate 94 on the floor, and press the steam/vacuum cleaner 10 onto the steam/vacuum cleaner 10.

FIG. 8 is a cross-sectional view of the foot 14 taken through line VIII-VIII of FIG. 2. The outlet portion of the steam nozzle 122 projects through the steam port 124 in the base frame 114 toward the steam orifice 54 in the pad mounting plate 94. A flexible seal 180 is provided around the steam nozzle 122 and positioned between the steam port 124 and the steam orifice 54 for preventing steam leakage into the foot 14. The seal 180 is generally spool-shaped, with a barrel 182 having an upper flange 184 and a lower flange 186. The barrel 182 extends through the steam port 124, with the upper flange 184 holding the seal 180 on the base frame 114. The lower flange 186 contacts the upper surface of the pad mounting plate 94 and surrounds the steam orifice 54.

As disclosed above, the foot 14 is supported by wheels 118, 120 that are mounted on the base frame 114. The pad mounting plate 94 can float relative to the base frame 114 to some extent, such that there is some vertical play between the pad mounting plate 94 and the rest of the foot 114 when the pad mounting plate 94 is coupled to the foot 14. The seal 180 compensates for the vertical float of the pad mounting plate 94 by flexing or compressing as needed to maintain contact between the lower flange 186 and the pad mounting plate 94, and prevents steam leaks from the steam nozzle 122 between the base frame 114 and the top side of the pad mounting plate 94 so that all steam flows through the steam orifice 54 to the cleaning pad 58.

Figure 9:
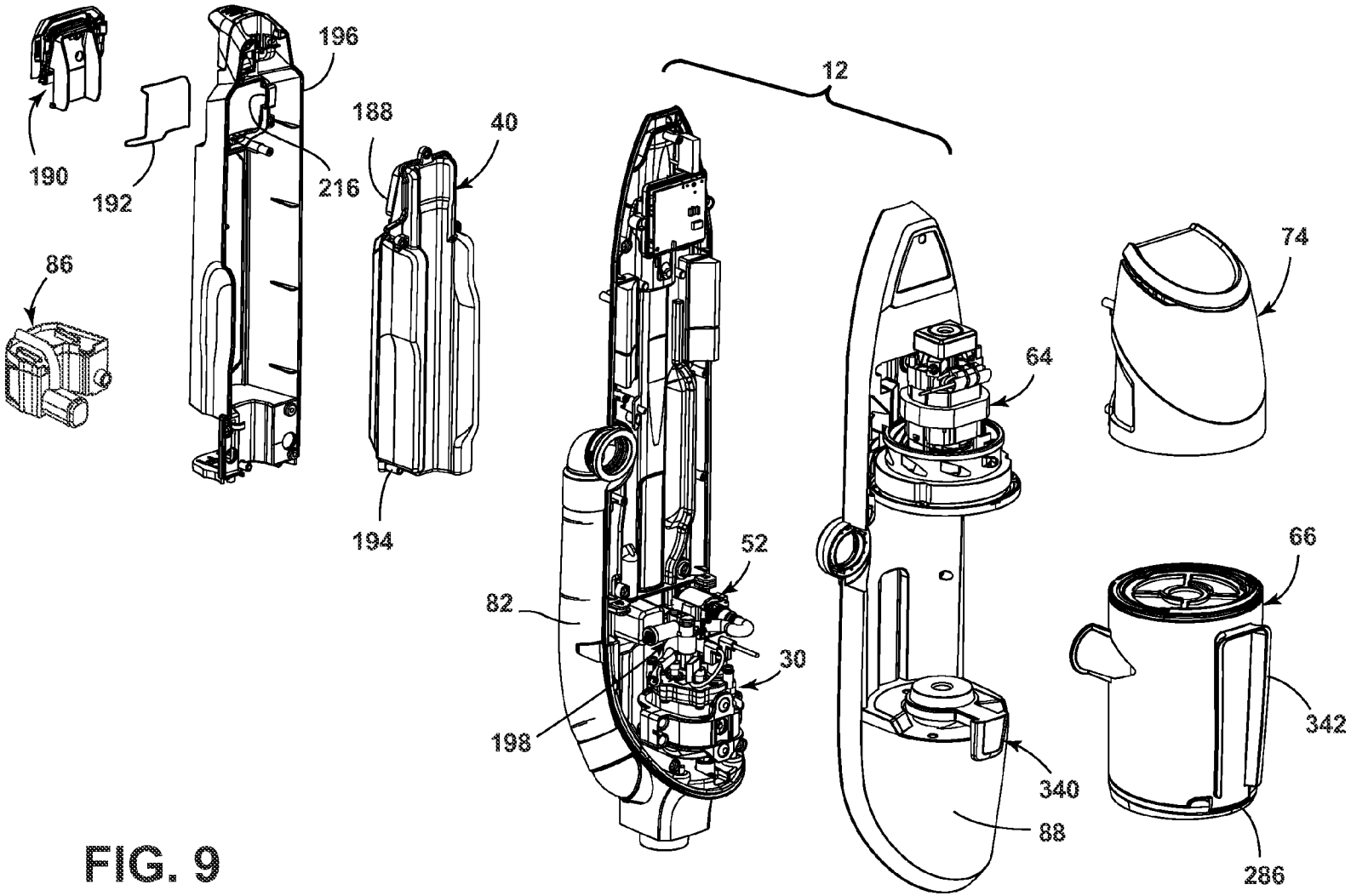
FIG. 9 is a partially exploded view of an upper housing of the steam/vacuum cleaner from FIG. 2.

FIG. 9 is a partially exploded view of the upper housing 12. The supply tank 40 defines a chamber for receiving a supply of liquid and has a fill opening 188 that is selectively closed by a fill cap 190. A seal 192 is provided between the supply tank 40 and the fill cap 190 for sealing the interface between the fill cap 190 and the supply tank 40 when the fill cap 190 is closed, and can be carried by the supply tank 40. An outlet port 194 is provided at a lower end of the supply tank 40 and fluidly connects the chamber with the filter assembly 86. In the illustrated embodiment, the supply tank 40 is provided on the upper housing 12, and is not removable therefrom by the user for refilling. A rear cover 196 mounts the supply tank 40 to the upper housing 12, and is not intended for removal by the user of the steam/vacuum mop 10.

In this embodiment, the pump 52 is provided in the upper housing 12, in the heater cavity 88, to control the flow of liquid to the steam generator 30, also positioned in the heater cavity 88. The filter assembly 86 is in fluid communication with the pump 52. When the pump 52 is activated by squeezing the trigger 48, liquid flows through the pump 52 into the steam generator 30. A safety valve 198 can be positioned between the pump 52 and the steam generator 30 for relieving pressure exceeding a predetermined value within the fluid flow path. For example, the safety valve 198 can be configured to automatically open to release excess fluid pressure into the atmosphere in potential situations where the flow path becomes clogged or obstructed and the steam generator 30 or pump 52 continues to generate pressure within the system.

Figure 10:
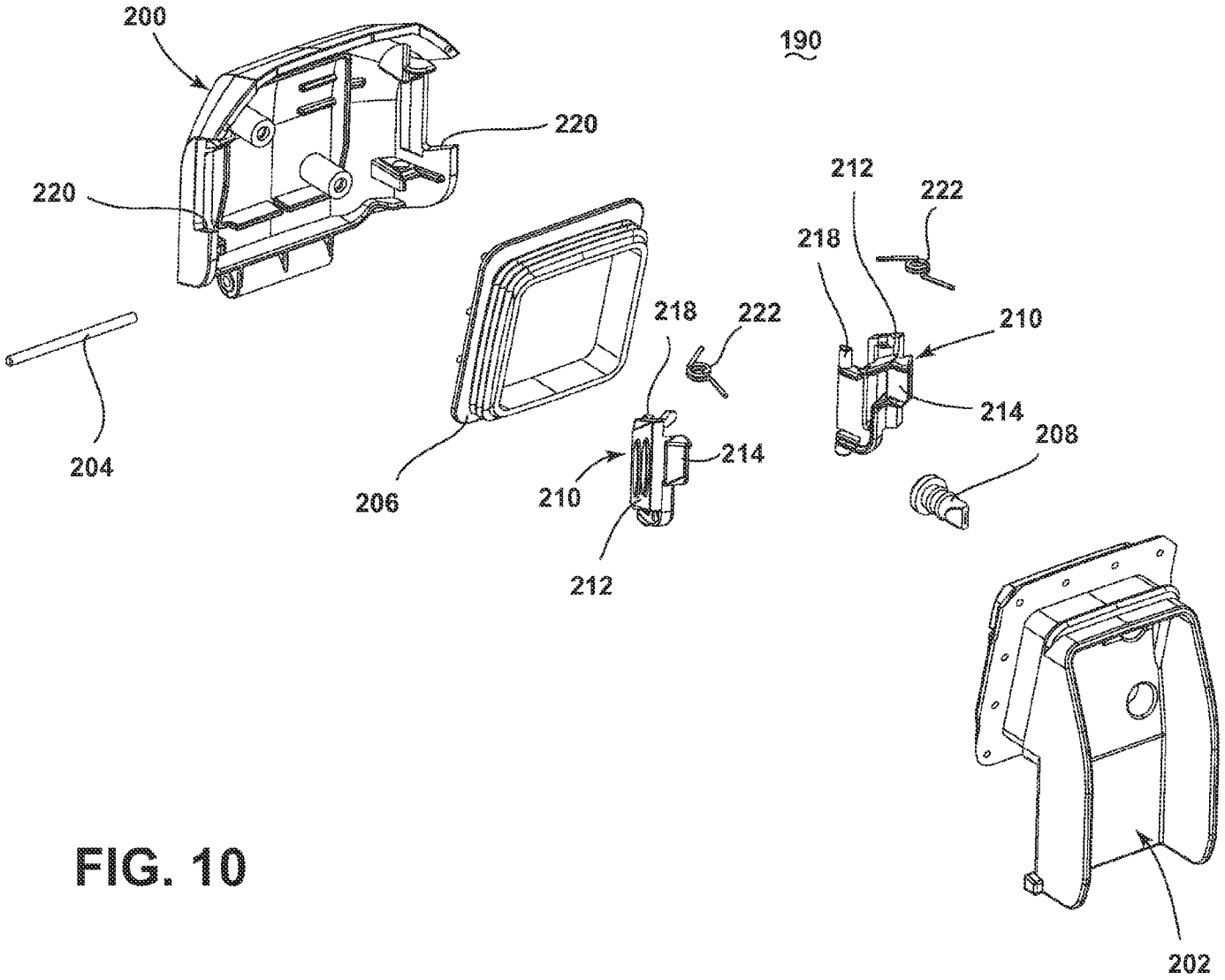
FIG. 10 is an exploded view of a fill cap for a supply tank of the steam/vacuum cleaner from FIG. 2.

FIG. 10 is an exploded view of the fill cap 190 from FIG. 9. The fill cap 190 comprises a cap body 200 and a funnel 202 provided on an inner surface of the cap body 200 for filling the supply tank 40. While illustrated herein as being formed in two pieces, the funnel 202 can alternatively be integrally formed with the cap body 200. The cap body 200 is pivotally mounted to the rear cover 196 (FIG. 9) by a pivot shaft 204. A bellows-type seal 206 is provided between the supply tank 40 and the fill opening 188 for sealing around the funnel 202 when the fill cap 190 is closed, and can be carried by the fill cap 190. A bleeder valve 208 is provided on the fill cap 190 and is configured to vent ambient atmospheric air into the supply tank 40 (FIG. 9) as liquid inside the supply tank 40 is dispensed during use.

The fill cap 190 has a latch mechanism for selectively latching the fill cap 190 in a closed position on the supply tank 40 (visible in FIG. 3). The latch mechanism comprises a pair of juxtaposed latches 210 having a user-engageable outer buttons 212 and inner hooks 214 coupled with the buttons 212. The hooks 214 are configured to be retained by corresponding latch receivers 216 formed on the upright housing 12, shown on the rear cover 196 in FIG. 9.

The latches 210 have vertical pivot shafts 218 for pivotally mounting the latches 210 to pivot bearings 220 formed on an inner surface to the cap body 200. Biasing elements 222 can be provided to bias the latches 210 toward the latched position, which corresponds to the closed position shown in FIG. 3. The biasing elements 222 can comprise springs in the form of torsion springs wrapped around the pivot shafts 218 and bearing against the cap body 200.

Figure 11:
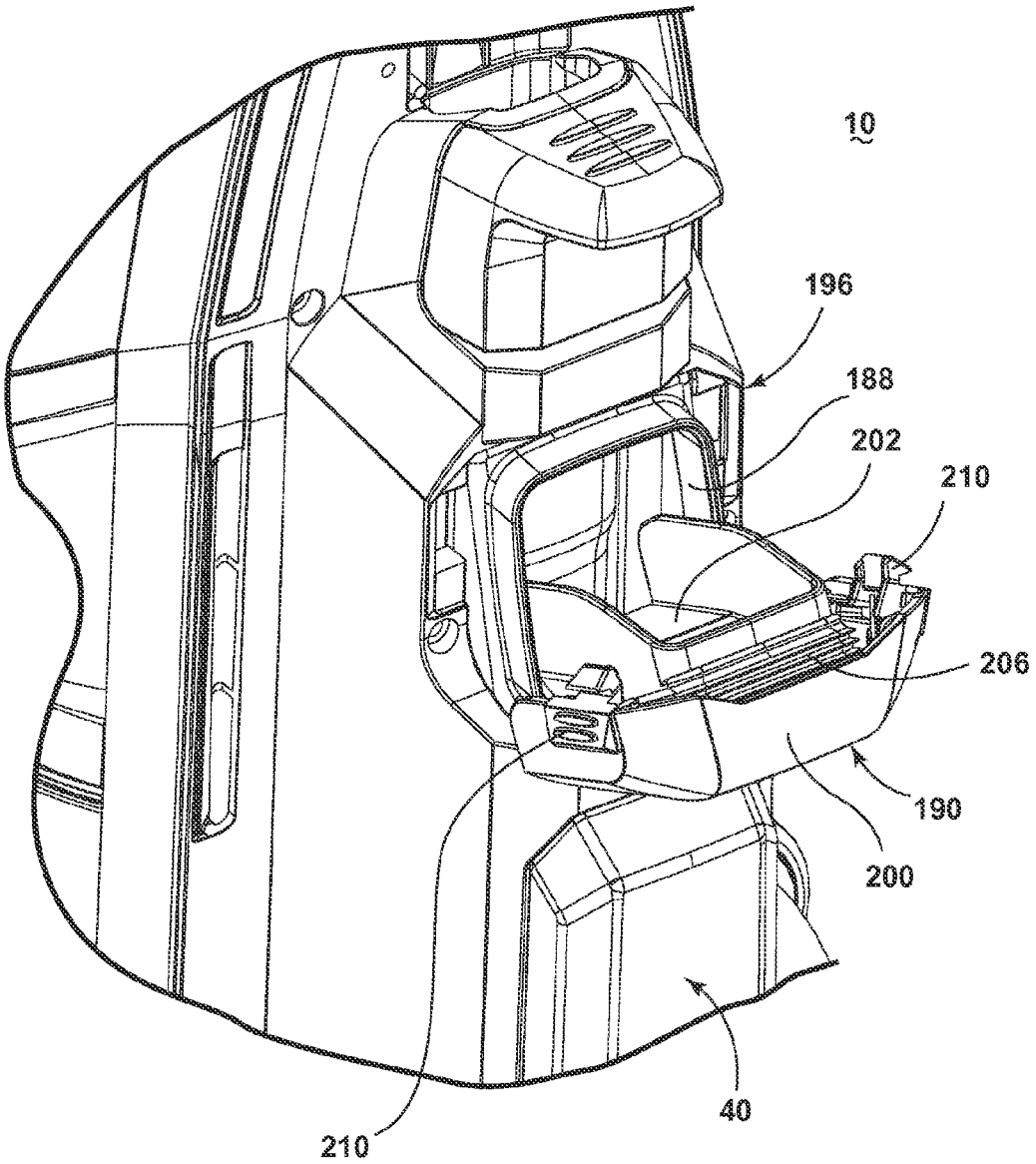
FIG. 11 is a close-up rear perspective view of the steam/vacuum cleaner from FIG. 2, showing a fill cap for the supply tank in an open or filling position.

FIG. 11 is a close-up rear perspective view of the steam/vacuum cleaner 10 from FIG. 2, showing the fill cap 190 for the supply tank 40 in an open or filling position. The fill cap 190 can be opened by squeezing the latches 210 and pivoting the cap body 200 backward about the pivot shaft 204 (FIG. 10). When the fill cap 190 is open, the funnel 202 can convey liquid from a liquid source, such as a faucet, hose, or a separate user liquid supply vessel, into the fill opening 188 of the supply tank 40. Because the supply tank 40 is not removed from the steam/vacuum cleaner 10 for filling, the extended funnel 202 makes it easier to fill the supply tank 40. Furthermore, because the fill cap 190 is hinged to the supply tank 40, the fill cap 190 will not completely separate from the supply tank 40 during filling and, therefore, will not be dropped or lost.

Figure 12:
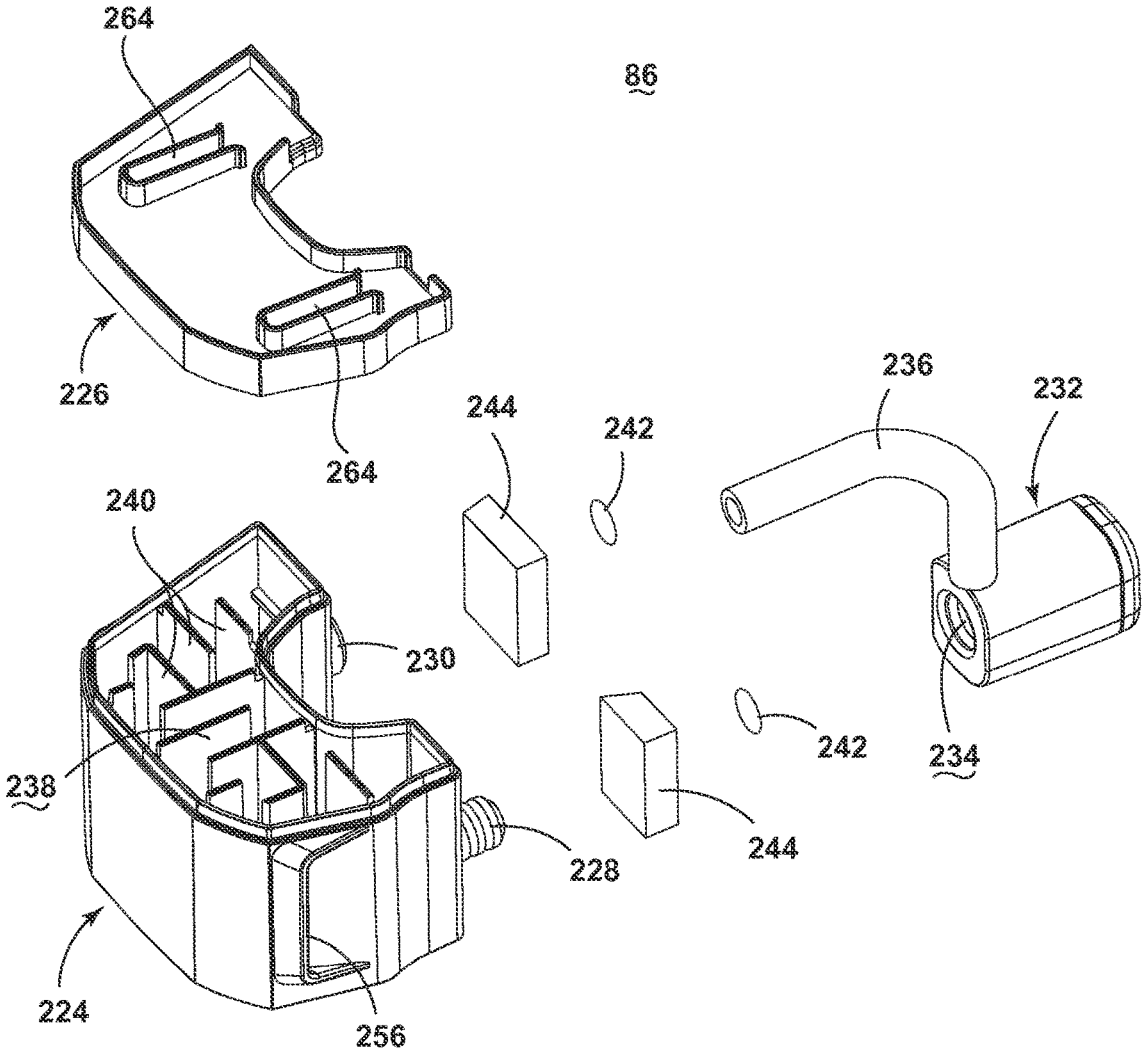
FIG. 12 is an exploded view of a filter assembly of the steam/vacuum cleaner from FIG. 2.

FIG. 12 is an exploded view of the filter assembly 86. The filter assembly 86 is configured to prevent foreign particulates and debris from entering the steam generator 30 and comprises a filter housing 224 and a filter cover 226 removably mounted to the filter housing 224. The filter housing 224 can further include an inlet neck 228 defining an inlet port in fluid communication with the outlet port 194 of the supply tank 40 and outlet neck 230 defining an outlet port which is in fluid communication with the pump 52 (FIG. 9).

A valve assembly 232 can be positioned between the outlet port 194 of the supply tank 40 and the inlet neck 228 of the filter housing 224, and includes a valve outlet seat 234 for receiving the inlet neck 228. A fluid conduit 236 can couple the valve assembly 232 to the outlet port 194 of the supply tank 40. The valve assembly 232 is adapted to move to a closed position to seal the fluid conduit 236 when the filter assembly 86 is removed from the steam/vacuum cleaner 10. When the filter assembly 86 is seated on the steam/vacuum cleaner 10, the inlet neck 228 is at least partially received within the valve outlet seat 234 to automatically move the valve assembly 232 to an open position to allow fluid flow through the fluid conduit 236.

A filtration medium 238 is provided in the filter housing 224, and can comprise a granular substance such as mixed bed ion exchange resin or polymer, which can further comprise crosslinked polystyrene beads, for example, that are configured to purify and decontaminate liquid from the supply tank 40. Accordingly, the filter housing 224 may be provided with a plurality of internal walls 240 that form a frame work for holding the filtration medium 238 and which can provide a labyrinthine structure for liquid to pass through. Additional filtration mediums can be provided in the filter assembly 86, such as mesh screens 242 and sponge filters 244 positioned at the inlet and outlet necks 228, 230.

Figure 13:
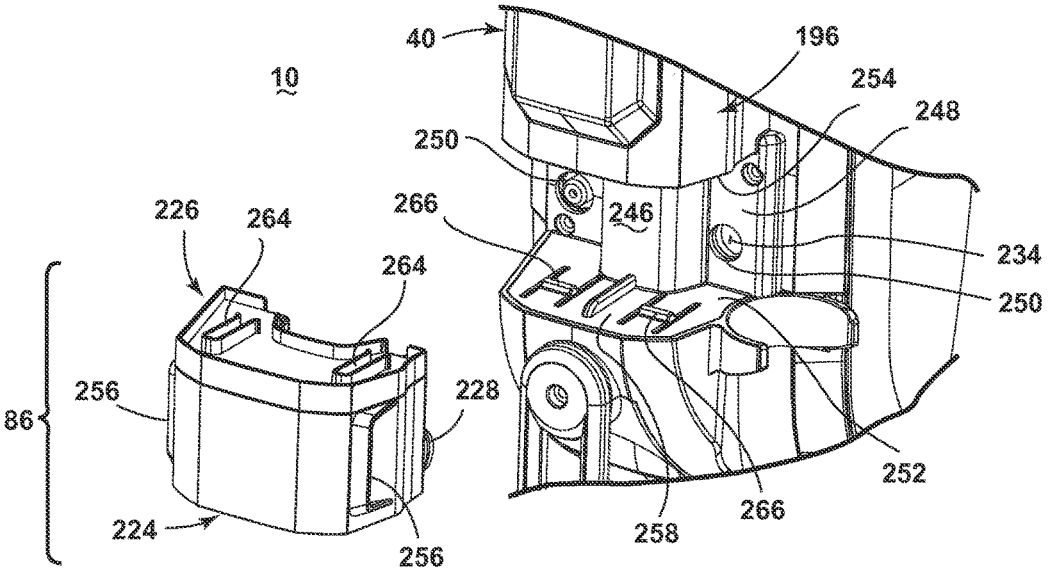
FIG. 13 is a partially exploded view of the steam/vacuum cleaner from FIG. 2, showing the filter assembly removed from the steam/vacuum cleaner from a top perspective.
Figure 14:
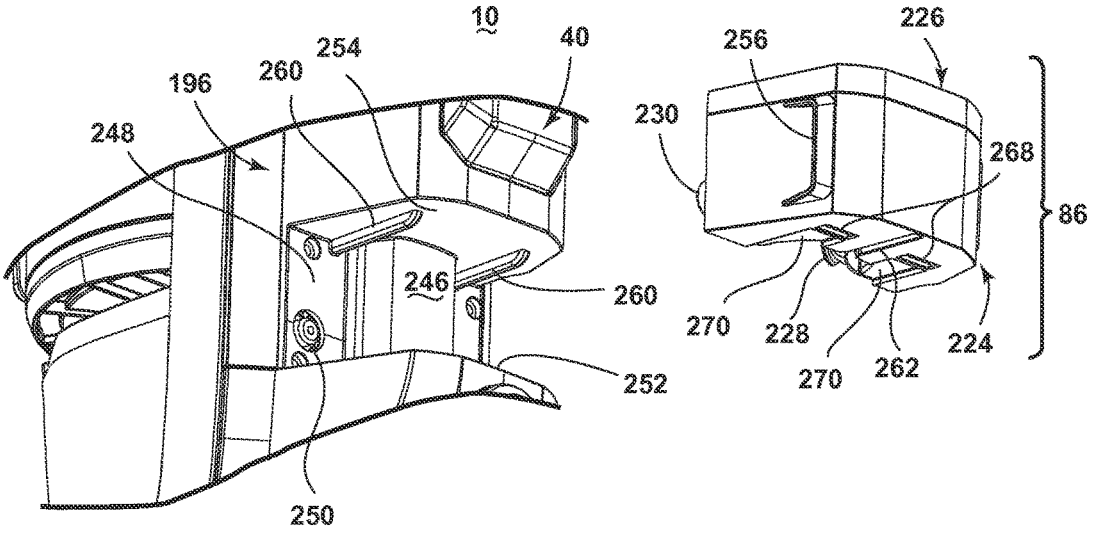
FIG. 14 is a partially exploded view of the steam/vacuum cleaner from FIG. 2, showing the filter assembly removed from the steam/vacuum cleaner from a bottom perspective.

FIGS. 13-14 are partially exploded views showing the filter assembly 86 removed from the steam/vacuum cleaner 10 from a top and bottom perspective. The filter assembly 86 can be removable from the steam/vacuum cleaner 10. The steam/vacuum cleaner 10 comprises a filter receiver 246 for receiving the filter assembly 86. The filter receiver 246 can be defined by the rear cover 196 and comprises a rear wall 248 with openings 250 which facilitate fluid connection of the filter assembly 86 with the valve outlet seat 234 and the pump 52 (FIG. 9), a platform 252, and a ceiling 254, at least one of which can have coupling features for releasably retaining the filter assembly 86 within the filter receiver 246. Hand grips 256 can be provided on the filter housing 224 for aiding the user in removing the filter assembly 86 from the steam/vacuum cleaner 10. The valve assembly 232 is not removable from the steam/vacuum cleaner 10 with the filter assembly 86.

The filter receiver 246 includes rails 258, 260 provided on the platform 252 and the ceiling which can be slidingly received by corresponding grooves 262, 264 on the filter assembly 86. In the illustrated embodiment, the platform 252 is provided with one rail 258 which can be received by a corresponding groove 262 on the bottom of the filter housing 224, and the ceiling 254 is provided with two rails 260 which can be received by corresponding grooves 264 on the top of the filter cover 226.

The filter receiver 246 further includes at least one detent 266 which can be received by a corresponding detent receiver 268 on the filter assembly 86 to retain the filter assembly 86 on the steam/vacuum cleaner 10 when the upper housing 12 is inclined during use. In the illustrated embodiment, the platform 252 is provided with two detents 266 positioned outside the guide rail 258 which are received by corresponding detent receivers 268 on the bottom of the filter housing 224. Detent guides 270 leading to the detent receivers 268 can be provided on the bottom of the filter housing 224 and can guide the detents 266 into the detent receivers 268 by aligning the detents 266 with the detent receivers 266 as the filter assembly 86 slides over the rails 258, 260.

Figure 15:
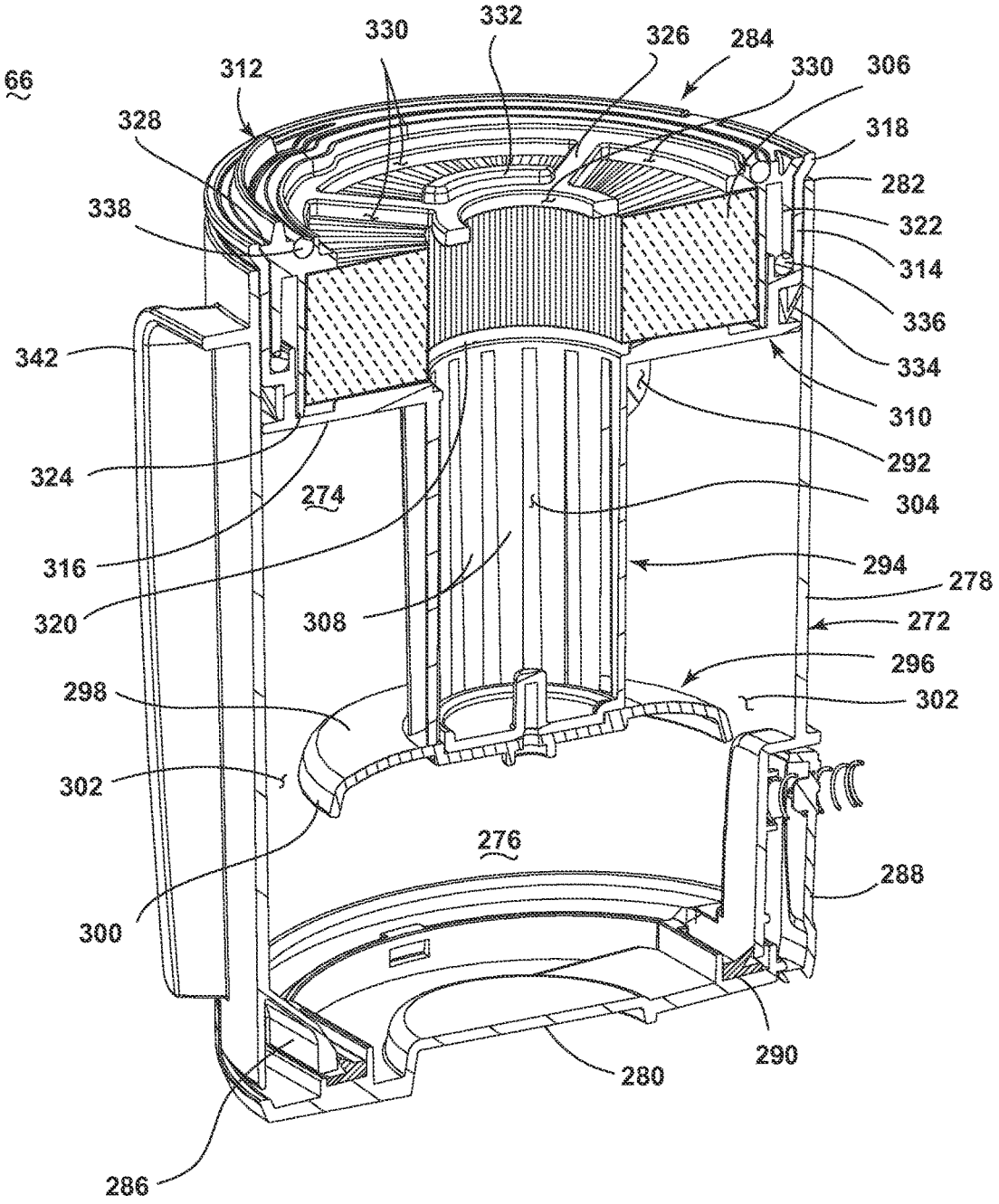
FIG. 15 is a perspective, cross-sectional view of a collection system for the steam/vacuum cleaner from FIG. 2.

FIG. 15 is a perspective, cross-sectional view of the collection assembly 66. The collection assembly 66 comprises a housing 272 at least partially defining a single-stage cyclone chamber 274 for separating contaminants from a dirt-containing working airstream and an integrally-formed dirt collection chamber 276 which receives contaminants separated by the cyclone chamber 274. The housing 272 is common to the cyclone chamber 274 and the collection chamber 276, and includes a side wall 278, a bottom wall 280, and an open top defined by an upper edge 282 of the side wall 278. The side wall 278 is illustrated herein as being generally cylindrical in shape. The bottom wall 280 comprises a dirt door that can be selectively opened, such as to empty the contents of the collection chamber 278. A cover assembly 284 is removably mounted to the housing 272 to partially close the open top.

The dirt door 280 is pivotally mounted to the side wall by a hinge 286. A door latch 288 is provided on the side wall 278, opposite the hinge 286, and can be actuated by a user to selectively release the dirt door 280 from engagement with the bottom edge of the side wall 278. The door latch 288 is illustrated herein as comprising a latch 288 that is pivotally mounted to the side wall 278 and spring-biased toward the closed position shown in FIG. 15. By pressing the upper end of the door latch toward the side wall 278, the lower end of the door latch 288 pivots away from the side wall 278 and releases the dirt door 280, under the force of gravity, allowing accumulated dirt to be emptied from the collection chamber 276 through the open bottom of the housing 272. A gasket 290 can be provided between the dirt door 280 and the bottom edge of the side wall 278 to seal the interface therebetween when the dirt door 280 is closed.

An air inlet to the cyclone chamber 274 can be at least partially defined by an inlet conduit 292. An air outlet from the cyclone chamber 274 can be at least partially defined by an exhaust grill 294 which guides working air out of the housing 272. The inlet conduit 292 is in fluid communication with the suction nozzle 62 (FIG. 2) and the exhaust grill 294 is in fluid communication with the suction source 64 (FIG. 9). The exhaust grill 294 is positioned in the center of the cyclone chamber 274 and can depend from a bottom wall of the cover assembly 284. A separator plate 296 can be provided below the exhaust grill 294 to separate the cyclone chamber 274 from the collection chamber 276, and can include a disk-like surface 298 extending radially outwardly from the grill 294 and a downwardly depending peripheral lip 300. A debris outlet 302 from the cyclone chamber 274 can be defined between the separator plate 296 and the side wall 278 of the housing 272. The exhaust grill 294 separates the cyclone chamber 274 from a passageway 304 leading to a pre-motor filter 306 within the cover assembly 284, and includes a generally cylindrical body having a plurality of longitudinally-extending vanes or louvers 308.

The cover assembly 284 includes a lower cover 310 and an upper cover 312 which can be mounted to the lower cover 310 and which together define a filter chamber which can receive the filter 306. The lower cover 310 includes a side wall 314, a bottom wall 316, and an open top defined by an upper edge 318 of the side wall 314. The upper edge 318 of the side wall 314 can be formed as a lip, which rests on the upper edge 282 of the housing 272 when the cover assembly 284 is received in the open top of the housing 272. The bottom wall 316 includes a central opening 320 allowing air to pass out of the exhaust grill 294. The upper cover 312 includes a side wall 322, an open bottom defined by a lower edge 324 of the side wall 322, and a top wall 326. The top wall 326 can have a lattice-like frame with a peripheral lip 328, which rests on the upper edge 318 of the lower cover 310 when the upper cover 312 is received in the lower cover 310. The frame includes a multiple openings 330 allowing air to pass out of the filter 306. A handle grip 332 attached to the top wall 326 can be gripped by a user to facilitate lifting the upper cover 312 off the lower cover 310 to access the filter 306 for cleaning or replacement. The filter 306 can comprise a pleated HEPA filter. A first seal 334 is provided between the lower cover 310 and the housing 272, a second seal 336 is provided between the lower cover 310 and upper cover 31, and a third seal 338 is provided on top of the upper cover 312 for providing fluid-tight interfaces therebetween.

With additional reference to FIG. 9, the collection assembly 66 can have a latch mechanism 340 that selectively secures the collection assembly 66 to the steam/vacuum cleaner 10 in a position to receive debris, and optionally some amount of liquid. The latch mechanism 340 also allows the collection assembly 66 to be selectively removed from the steam/vacuum cleaner 10, as shown in FIG. 9, so that the collection chamber 276 can be emptied and the filter 306 can be cleaned or replaced. A handle grip 342 attached to the housing 272 can be gripped by a user to facilitate removing collection assembly 66 from the upper housing 12.

Aspects of the liquid distribution system 26, steam delivery system 28 and vacuum collection system 60 of the steam/vacuum cleaner 10 shown in FIGS. 2-15 have been developed to work in combination with each other to prevent a perceptible amount of liquid from entering the collection assembly 66 during operation. For example, the flow rate of liquid through the liquid distribution system 26 has been limited within a predetermined range to prevent over-wetting the surface to be cleaned and to prevent ingesting liquid into the collection assembly 66, while still supplying a sufficient amount of steam to the surface for cleaning. In one embodiment, the liquid flow rate, which can be measured by determining the amount of liquid flowing out of the supply tank 40 during a period of continuous operation in which the steam/vacuum cleaner 10 is energized with the valve 50 open, is between 20 ml/min and 25 ml/min. This liquid flow rate range has been shown to provide effective cleaning performance while minimizing potential for over-wetting the surface to be cleaned and ingesting liquid into the collection assembly 66. Preventing a perceptible amount of liquid from entering the collection assembly 66 is advantageous because liquid ingested into the collection assembly 66 can wet the debris collected therein, which can potentially clog filter(s) 68, impede proper function of the steam/vacuum cleaner 10 and cause odors over time.

Additionally, the air performance of the vacuum collection system 60 and suction source 64 has been configured to effectively ingest dry debris while simultaneously preventing a perceptible amount of liquid from entering the collection assembly 66 during operation. For example, the suction pressure—also referred to as lift, which is defined as the absolute difference between ambient and subatmospheric pressure, can be specified within a predetermined range so that the steam/vacuum cleaner 10 effectively ingests dry debris and does not ingest a perceptible amount of liquid in the collection assembly 66. The lift can be specified for the entire cleaner 10 and/or for the bare suction source 64 (i.e. independent of the cleaner 10) for an open inlet condition in which an operating orifice is provided and a sealed inlet condition in which no operating orifice is provided. Thus, a range of lift values can be specified which, when executed in combination with other vacuum collection system 60 variables such as the configuration of the air path, including the conduit 82, fluid conduit 128, flue 126 and suction nozzle 62, can result in the desired cleaning performance and minimal liquid ingestion.

The lift can be measured in accordance with ASTM F 558—Standard Test Method for Measuring Air Performance Characteristics of Vacuum Cleaners and can be expressed in inches of water (IOW). In one embodiment, the suction source 64 is a peripheral bypass motor and lift measured at the suction nozzle 62 of the cleaner 10 in an open inlet condition using a 0.75 inch orifice aligned with the suction nozzle 62 is approximately 10 IOW, whereas the lift measured at the suction nozzle 62 using a sealed inlet condition is approximately 40 IOW. The measured lift of the same peripheral bypass motor as a bare suction source 64 in an open inlet condition using a 0.75 inch orifice is approximately 12 IOW.

Additionally, the configuration of the air path between the suction nozzle 62 and the collection assembly 66, such as the curvature, number of bends or turns, internal diameter and surface area of the conduit 82, fluid conduit 128, flue 126 and suction nozzle 62 can collectively form a condensation trap that functions to prevent a perceptible amount of liquid from entering the collection assembly 66 during operation.

The steam/vacuum cleaner 10 shown in FIGS. 2-15 can be used to effectively remove liquid and debris (which may include dirt, dust, stains, and other debris) from the surface to be cleaned in accordance with the following method. The sequence of steps discussed is for illustrative purposes only and is not meant to limit the method in any way as it is understood that the steps may proceed in a different logical order, additional or intervening steps may be included, or described steps may proceed concurrently, or be divided into multiple steps, without detracting from the invention.

In operation, the steam/vacuum cleaner 10 can be utilized in a vacuum only mode, a steam only mode, or a concurrent vacuum and steam mode. For vacuum cleaning, the suction source 64 is energized and draws liquid and debris-containing air from the suction nozzle 62 through the circuitous working air path, including the flue 126, fluid conduit 128 and conduit 82, which can trap and evaporate moisture before the working air enters the collection assembly 66 where the debris and any remaining liquid are separated from the working air. Although the collection assembly 66 can be configured to separate liquid from the working air, most or all of the liquid is separated from the working airstream prior to entering the collection assembly 66, and so any remaining liquid would be imperceptible. The working air, which may still contain some smaller or finer debris, then passes through the exhaust grill 294 which can separate out some additional debris. The working air, which may still contain some even smaller or finer debris, passes through the pre-motor filter 306, where additional debris may be captured. The working air then exits the collection system 66 and passes through the suction source 64 before being exhausted from the steam/vacuum cleaner 10. One or more additional filter assemblies may be positioned upstream or downstream of the suction source 64. To dispose of collected debris and any remaining imperceptible amount of liquid, the collection system 66 is detached from the steam/vacuum cleaner 10.

For steam cleaning, the cleaning pad 58 is attached to the foot 14, the supply tank 40 is filled with liquid, and the power cord 38 is plugged into a household electrical outlet. Upon pressing the trigger 48, the pump 52 is activated and liquid flows from the supply tank 40, through the filter assembly 86, to the steam generator 30. In the steam generator 30, liquid is heated to its boiling point to produce steam. The generated steam exits the steam generator 30 and guided downwardly to the foot and through the steam nozzle 122 towards the surface to be cleaned. As steam passes through the cleaning pad 58, a portion of the steam may return to liquid form before reaching the floor surface. A portion of the steam delivered to the floor surface can also return to liquid form. As the damp cleaning pad 58 is wiped over the surface to be cleaned, at least some excess liquid and debris on the surface can absorbed by the cleaning pad 58. Liquid and debris can also be removed from the surface to be cleaned by operation of the vacuum collection system 60.

Operating in the concurrent vacuum and steam mode, the steam generator 30 and suction source 64 operate concurrently such that steam delivery and suction pick-up occur at the same time, or at least partially overlap each other. With the steam/vacuum cleaner 10, the collection assembly 66 remains perceptibly dry during and after concurrent operation of the steam generator 30 and suction source 64. Prior art designs for combination steam/vacuum cleaner must energize either a steam generator or vacuum motor separately to maintain a dry collection assembly since simultaneous operation of the vacuum and steam functions of these prior devices would result in a damp or wet collection assembly. Moisture in the collection assembly can form a muddy mixture of debris and liquid that reduces the effectiveness and usability of the cleaner. Additionally, another reason for separate operation of the steam generator and vacuum motor in prior design is to avoid exceeding typical amperage limits on residential circuits. Prior combination steam/vacuum cleaners have specifically avoided a concurrent vacuum and steam mode by using separate control switches which permit only one of the steam generator or vacuum motor to be active at a time, requiring a plate for supporting a cleaning pad during steam cleaning which blocks the suction nozzle, or requiring a user to change out different feet for steam cleaning and vacuuming. The steam/vacuum cleaner 10 of the embodiment of the invention disclosed herein avoids such inconvenient and cumbersome requirements, and is instead configured to for concurrent steam and vacuum functions, but avoids the problem of collecting a muddy mixture of debris and liquid by preventing a perceptible amount of liquid from entering the collection assembly and thereby only collecting perceptibly dry debris.

Another benefit of at least one embodiment of the invention disclosed herein is the use of a cyclonic separating and collection assembly in the combination steam/vacuum cleaner 10. Floor cleaners that dispense and recover liquid generally do not use centrifugal or cyclonic separators because the high-speed swirling air flow tends to generate excessive foam when liquid and residual solution are recovered in the collector, which is undesirable from a separation standpoint. Here, most or all of the liquid is separated from the working airstream prior to entering the collection assembly 66, so foam generation is not an issue. Also, the swirling air flow within the cyclone chamber 274 may tend to separate any residual moisture or liquid droplets that remain entrained in the working air flow entering the collection assembly 66. The residual droplets may be flung outwardly to the side wall 278 of the housing 272, with the high-speed swirling air flow causing a sheeting action in which the droplets spread out on the side wall 278 into thin streaks. The swirling air flow can then more effectively and quickly evaporate any residual moisture so that no perceptible amount of liquid is present within the collection chamber 276. Prior floor cleaners with bulk separators not having cyclonic action are not as capable of handling residual moisture as effectively because recovered liquid may tend to pool at the bottom of the collector in a deeper puddle that cannot be evaporated.

Laboratory testing was conducted to evaluate the level of moisture inside the collection assembly 66 after a period of normal operation in which vacuum and steam functions were operated concurrently and continuously. The purpose of the testing was to ascertain the effectiveness of the combination of previously described aspects of the liquid distribution system 26, steam delivery system 28 and vacuum collection system 60, such as the specified liquid flow rates, suction parameters and air path configuration, at preventing a perceptible amount of liquid from entering the collection assembly 66. The results of the laboratory testing show that the collection assembly 66 was dry after operating the steam/vacuum cleaner 10 to clean a 100 square foot section of hard surface flooring.

For the testing, a steam/vacuum cleaner 10 as shown in FIGS. 2-15 was prepared for use by filling the supply tank 40 with distilled water. Next, a new, unused cleaning pad 58 was installed onto the pad mounting plate 94, which was coupled to the foot 14. Prior to installing the cleaning pad 58, the cleaning pad 58 was washed and dried in a residential style washer and dryer appliance set to ensure that no foreign substances or residue were present on the pad 58, which could potentially affect moisture absorption of the pad 58. A section of hard flooring having an area of 100 square feet ($ft^2$) and dimensions of 10 feet by 10 feet was used to conduct the test. A regulated power supply was used to supply 120 VAC to the steam/vacuum cleaner 10 and the steam/vacuum cleaner 10 was energized and set to operate in concurrent vacuum and steam mode. The liquid distribution system 26 was primed by actuating the trigger for 15 seconds to start the flow of steam. The cleaning process employed during the test comprised continuously applying steam while performing two cleaning cycles over adjacent portions of the floor, referred to as cleaning paths, which were the same width as the cleaning pad 58. One cleaning cycle was defined as one forward stroke and one rearward or return stroke along the same cleaning path at a constant stroke speed of 8.0 inches/second. The cleaning process was repeated until the entire 100 $ft^2$ hard floor surface area was cleaned. Upon cleaning the entire 100 $ft^2$ area, the collection assembly 66 was removed and visually inspected for signs of moisture. The entire inside surface of the collection assembly 66 was then wiped with a moisture-absorbing paper towel. No signs of moisture were observed in the collection assembly or on the paper towel at the conclusion of the test. Additionally, no signs of moisture were observed inside the collection assembly 66 at any time during the test.

While the invention has been specifically described in connection with certain specific embodiments thereof, it is to be understood that this is by way of illustration and not of limitation. Reasonable variation and modification are possible with the scope of the foregoing disclosure and drawings without departing from the spirit of the invention which, is defined in the appended claims. Hence, specific dimensions and other physical characteristics relating to the embodiments disclosed herein are not to be considered as limiting, unless the claims expressly state otherwise.

What is claimed is:

1. A combination steam and vacuum surface cleaning apparatus, comprising:

a cleaning housing movable along the surface to be cleaned;

a vacuum collection system comprising:

a suction source;

a suction nozzle provided on the cleaning housing for proximal contact with a surface to be cleaned; and a debris separating and collection assembly in fluid communication with both the suction source and the suction nozzle;

a liquid distribution system comprising a liquid supply tank;

a steam generation system comprising a steam generator having a liquid inlet in fluid communication with the liquid supply tank;

a steam delivery system for delivering a flow of steam from the steam generator to at least one steam outlet provided on the cleaning housing, wherein the at least one steam outlet is spaced apart from the suction nozzle and positioned to downwardly direct the flow of steam toward the surface to be cleaned, the at least one steam outlet further comprising a steam orifice that includes a substantially horizontally oriented deflector that blocks the downwardly directed flow of steam and redirects the entire flow of steam in a direction away from the suction nozzle; and a cleaning pad with a bottom surface for contact with the surface to be cleaned, the cleaning pad attachable to the cleaning housing below the at least one steam outlet to form a barrier from the suction nozzle such that the steam that is dispensed from the steam orifice is forced through the cleaning pad instead of bypassing the cleaning pad and flowing directly into the suction nozzle;

wherein the steam generator and suction source can be energized concurrently to deliver steam to the surface to be cleaned and simultaneously remove and collect debris and liquid from the surface to be cleaned, and wherein the separating and collection assembly remains perceptibly dry during and after concurrent operation of the steam generator and suction source.

2. The combination steam and vacuum surface cleaning apparatus of claim 1, wherein the separating and collection assembly is a cyclonic separating and collection assembly.

3. The combination steam and vacuum surface cleaning apparatus of claim 2 and further comprising a working air conduit fluidly connecting the suction nozzle to the cyclonic separating and collection assembly, wherein the working air conduit comprises a condensation trap.

4. The combination steam and vacuum surface cleaning apparatus of claim 2, wherein the separating and collection assembly comprises a housing at least partially defining a cyclone chamber for separating debris from a working airstream and a collection chamber which receives debris separated by the cyclone chamber.

5. The combination steam and vacuum surface cleaning apparatus of claim 4, wherein the housing comprises a door selectively openable to empty the collection chamber.

6. The combination steam and vacuum surface cleaning apparatus of claim 1, wherein the deflector comprises a hood with a rearwardly-facing opening defining the steam orifice through which steam is guided.

7. The combination steam and vacuum surface cleaning apparatus of claim 1, and further comprising a mounting plate mounted to the cleaning housing and having a raised lip around the perimeter of a lower surface of the mounting plate, wherein the cleaning pad is mounted to the mounting plate such that the raised lip compresses the top of the cleaning pad.

8. The combination steam and vacuum surface cleaning apparatus of claim 1, and further comprising a barrier positioned rearwardly of the suction nozzle and forwardly of the at least one steam outlet for impeding steam or liquid from entering the suction nozzle.

9. The combination steam and vacuum surface cleaning apparatus of claim 8, wherein the barrier comprises a brush for agitating debris on the surface to be cleaned.

10. The combination steam and vacuum surface cleaning apparatus of claim 1 and further comprising a working air conduit fluidly connecting the suction nozzle to the separating and collection assembly, wherein the working air conduit comprises a condensation trap.

11. The combination steam and vacuum surface cleaning apparatus of claim 1, wherein the liquid distribution system comprises a low flow rate configured to prevent overwetting of the surface to be cleaned.

12. The combination steam and vacuum surface cleaning apparatus of claim 11, wherein the flow rate is between 20 ml/min and 25 ml/min.

13. The combination steam and vacuum surface cleaning apparatus of claim 1, wherein the vacuum collection system comprises a suction pressure configured to prevent a perceptible amount of liquid from entering the collection assembly.

14. The combination steam and vacuum surface cleaning apparatus of claim 1, wherein the liquid supply tank comprises an outlet in fluid communication with the liquid inlet of the steam generator.

15. The combination steam and vacuum surface cleaning apparatus of claim 1, and further comprising a brush for agitating debris on the surface to be cleaned and positioned rearwardly of the suction nozzle.

* * * * *